US005219694A

United States Patent [19]

Anno et al.

[11] Patent Number: 5,219,694

[45] Date of Patent: Jun. 15, 1993

[54] TONER FOR DEVELOPING ELECTROSTATIC LATENT IMAGE

[75] Inventors: Masahiro Anno, Sakai; Eiichi Sano, Takatsuki; Makoto Kobayashi, Settsu, all of Japan

[73] Assignee: Minolta Camera Kabushiki Kaisha, Osaka, Japan

[21] Appl. No.: 772,943

[22] Filed: Oct. 8, 1991

[30] Foreign Application Priority Data

| | | | |
|---|---|---|---|
| Oct. 9, 1990 | [JP] | Japan | 2-271258 |
| Nov. 8, 1990 | [JP] | Japan | 2-301077 |
| Nov. 13, 1990 | [JP] | Japan | 2-304051 |
| Nov. 13, 1990 | [JP] | Japan | 2-304052 |
| Nov. 13, 1990 | [JP] | Japan | 2-304053 |
| Nov. 13, 1990 | [JP] | Japan | 2-304054 |

[51] Int. Cl.[5] ..... G03G 9/083; G03G 9/097

[52] U.S. Cl. ..... 430/106.6; 430/109; 430/110

[58] Field of Search ..... 430/106.6, 109, 110, 430/137

[56] References Cited

U.S. PATENT DOCUMENTS

| | | | |
|---|---|---|---|
| 4,301,228 | 11/1981 | Kori et al. | 430/122 |
| 4,601,967 | 7/1986 | Suzuki et al. | 430/107 |
| 4,835,082 | 5/1989 | Koishi et al. | 430/109 |
| 4,859,560 | 8/1989 | Nakamura et al. | 430/137 |
| 5,077,168 | 12/1991 | Ogami et al. | 430/110 |

*Primary Examiner*—John Goodrow

*Attorney, Agent, or Firm*—Burns, Doane, Swecker & Mathis

[57] ABSTRACT

An electrostatic latent image-developing toner which comprises toner particles made of a binder resin and a coloring agent and functional minute particles to be attached to or fixed on the surface of toner particles for the purpose of imparting various functions expected of the electrostatic latent image-developing toner, wherein the functional minute particles are attached to or fixed on the surface of the toner particles in a high density locally.

23 Claims, 5 Drawing Sheets a : Rotation direction of magnet roller b : Moving direction of developing agents

TONER FOR DEVELOPING ELECTROSTATIC LATENT IMAGE

BACKGROUND OF THE INVENTION

1. Field of the Invention

This invention relates to a toner for the development of an electrostatic latent image. More particularly, this invention relates to an electrostatic latent image-developing toner to be used for the development of an electrostatic latent image in electrophotography, electrostatic recording, and electrostatic printing.

2. Description of the Prior Art

The development of an electrostatic latent image in electrophotography, electrostatic recording, and electrostatic printing is effected by causing a triboelectrified toner to be adsorbed electrostatically to an electrostatic latent image formed on a photosensitive material thereby visualizing the latent image. As means of electrifying the toner to be used in this development of an electrostatic latent image, the two-component developing method is known to effect the electrification by mixing the toner with a substance generally called a carrier for through dispersion therein and consequently imparting an electric charge to the toner and the one-component developing method to effect the electrification by establishing contact between the toner and a developing sleeve or a toner regulating blade.

Heretofore, the dry toner has been generally manufactured by a method which comprises mixing, melting, and blending a pigment such as carbon black in thermoplastic resin thereby preparing a homogeneous dispersion and then pulverizing the dispersion by the use of a suitable pulverizing device into a powder having a particle diameter proper for a toner. As other methods for the manufacture of the dry toner, those represented by the suspension polymerization method and the suspension pelletization method which effect the pulverization of the dispersion in a wet state have been also known. The suspension polymerization method, as disclosed in Japanese Patent Publications 36-10,231, 43-10,799, and 53-14,895, for example, effects the pulverization by suspending a polymerization composition having a polymerizing monomer, a polymerization initiator, and a coloring agent as its components in a non-solvent type medium and polymerizing the resultant suspension. The suspension pelletization method attains the pulverization by blending a synthetic resin with a coloring agent and other components, melting the resultant mixture, and suspending the molten mixture in a non-solvent type medium.

In recent years, in the copier and printer sectors of electrophotography, the toner has come to be urged to fulfill various functions concerning coloration of images, reduction of particle size and compaction of particle diameter distribution for the sake of image quality, expedition of the operation of image formation, enhancement of the reliability of quality, etc. In reply to these demands, techniques for uniformly attaching or fixing minute particles fulfilling the required functions to or on the surface of the toner particles have been proposed.

The toners having the functional minute particles uniformly attached to or fixed on their surface, however, fail to manifest the required functions to a fully satisfactory extent or, in spite of fully satisfactory initial functions, fail to retain the functions stably for a long time.

SUMMARY OF THE INVENTION

An object of the present invention, therefore, is to solve the problem just mentioned and, to this end, provide an electrostatic latent image-developing toner which attains lasting manifestation of outstanding properties.

Specifically, the present invention has as an object thereof the provision of an electrostatic latent image-developing toner which possesses an ideal triboelectric property and a fully contracted charge distribution and retains these properties stably for a long time.

The present invention aims to provide an electrostatic latent image-developing toner which is endowed with a lasting stable flowability without a sacrifice of the environmental stability of toner charge.

The present invention aims to provide an electrostatic latent image-developing toner which enjoys an improvement in a developing property and image density and manifests a fully satisfactory transferring property.

The present invention aims to provide an electrostatic latent image-developing toner which is suitable for the reduction in particle diameter required for the production of images of high quality.

The present invention aims to provide an electrostatic latent image-developing toner which overcomes the problem of drifting of toner particles in the site of development and, at the same time, manifests a fully satisfactory transferring property and produces images of high quality.

The present invention aims to provide an electrostatic latent image-developing toner which exhibits high reliability of quality in spite of the trend of the electrophotographic process toward acceleration of operational speed.

The present invention aims to provide an electrostatic latent image-developing toner which precludes the problem of poor cleanability of spherical toner particles.

To accomplish the objects described above in the present invention, the functional minute particles to be attached to or fixed on the surface of toner particles for the purpose of imparting various functions expected of the electrostatic latent image-developing toner are distributed in a high density locally. The ratio of presence of these functional minute particles on the surface of the toner particles are varied in accordance with the kind of the functional minute particles.

The first embodiment of this invention relates to an electrostatic latent image-developing toner which comprises toner particles made of a binder resin and a coloring agent and charge-controlling minute particles fixed in a high density locally on the surface of the toner particles so that the area in which the fixation density of the charge-controlling minute particles is not less than 1.5 times the average fixation density accounts for a proportion of not less than 20% of the entire surface of the toner particles.

The second embodiment of this invention relates to an electrostatic latent image-developing toner which comprises toner particles made of a binder resin and a coloring agent and minute particles of a fluidifying agent attached to or fixed on the surface of the toner particles in a high density locally so that the area in which the fixation density of the minute particles of fluidifying agent on the surface of the toner particles is not less than 1.5 times the average fixation density accounts for a proportion of not less than 20% of the entire surface of the toner particles.

The third embodiment of this invention relates to an electrostatic latent image-developing toner which comprises toner particles made of a binder resin and a coloring agent and non-insulating minute particles possessing a volume intrinsic electrical resistance of not more than $10^{10}$ Ω.cm attached to or fixed on the surface of the toner particles in a high density locally so that the area in which the fixation density of the non-insulating minute particles on the surface of the toner particles is not more than 50% of the average fixation density accounts for a proportion of not less than 20% of the entire surface of the toner particles.

The fourth embodiment of this invention relates to an electrostatic latent image-developing toner which comprises toner particles made of a binder resin and a coloring agent and magnetic minute particles attached to or fixed on the surface of the toner particles in a high density locally so that the area in which the fixation density of the magnetic minute particles on the surface of the toner particles is not less than 1.5 times the average fixation density accounts for a proportion of not less than 20% of the entire surface of the toner particles.

The fifth embodiment of this invention relates to an electrostatic latent image-developing toner which comprises spherical toner particles made of a binder resin and a coloring agent and inorganic or organic minute particles possessing an average particle diameter equaling 1/100 to 1/10 of the average particle diameter of the toner particles and attached to or fixed on the surface of the spherical toner particles in a high density locally so that the area in which the fixation density of the minute particles on the surface of the toner particles is not more than 50% of the average fixation density accounts for a proportion of not more than 20% of the entire surface of the toner particles.

The sixth embodiment of this invention relates to an electrostatic latent image-developing toner which comprises toner particles made of a binder resin and a coloring agent and highly dielectric minute particles possessing a dielectric constant of not less than 100 and fixed on the surface of the toner particles in a high density locally so that the fixation density of the highly dielectric minute particles on the surface of the toner particles is not less than 1.5 times the average fixation ratio. The term "dielectric constant" as used in the specification hereof refers to the magnitude determined with an AC voltage of 1 MHz in frequency at normal room temperature (25°±3° C.).

DETAILED DESCRIPTION OF THE INVENTION

Now, the present invention will be described in detail below with reference to the various embodiments thereof. The concrete material names of various functional minute particles used in the description are meant simply for facilitating the illustration of the invention. The functional minute particles to be used in the electrostatic latent image-developing toner of the present invention are not restricted in any sense to the concrete materials mentioned by way of illustration but may apply to the materials of similar functions known in the art.

First embodiment: addition of charge-controlling minute particles

When the toner incorporates a charge-controlling substance therein, the amount of charge imparted to the toner depends on the amount of the charge-controlling substance which is exposed on the surface of the toner. Generally, when the charge-controlling substance is fixed in the form of minute particles on the surface of the toner particles, the amount of the substance to be exposed is stabilized as compared with that of the substance to be exposed when this substance is distributed within the toner particles. By amply decreasing the size of the charge-controlling minute particles to be fixed on the surface of the toner particles, the dispersion of the weight of fixed charge-controlling substance among the toner particles due to the variation in the number of charge-controlling minute particles fixed on the individual toner particles can be curbed and, as a result, the distribution of charge in the toner can be appreciably contracted.

Figure 1A:
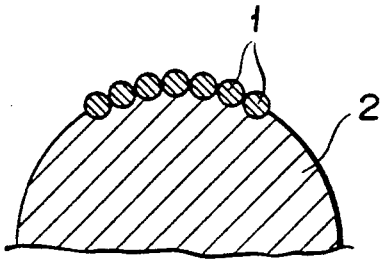
FIGS. 1*a* and *b* are sectional views illustrating in type the construction of an electrostatic latent image-developing toner particle according with the present invention.
Figure 1B:
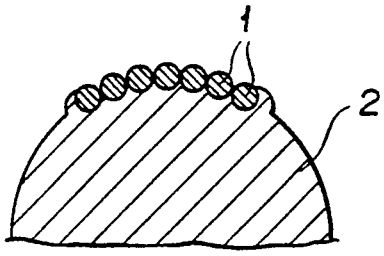
Figure 2A:
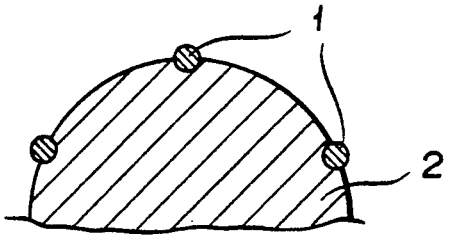
FIG. 2a Prior Art
FIGS. 2*a* and *b* are sectional views illustrating in type the construction of a conventional electrostatic latent image-developing toner particle.
Figure 2B:
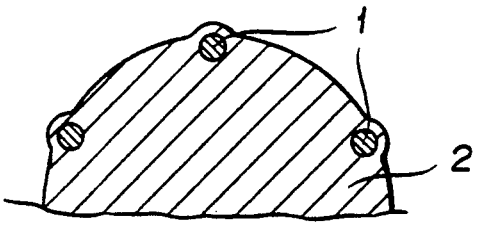
FIG. 2b Prior Art

When the charge-controlling minute particles of an amply decreased particle diameter are fixed on the surface of the toner particles and the resultant toner is stirred as a developing agent for a long time, the toner is liable to have the charging property thereof deteriorated because the exposed parts of the minute particles are eventually covered with the resin encircling the minute particles (as contained in the toner particles). The electrostatic latent image-developing toner in the first embodiment of this invention effectively precludes this liability and enables the fully contracted charge distribution to be maintained for a long time by causing the charge-controlling minute particles to be distributed in a high density locally. FIGS. 1*a* and *b* and FIGS. 2*a* and *b* are type diagrams illustrating the states just mentioned. When charge-controlling minute particles 1 are distributed as uniformly dispersed on the surface of a toner core particle 2 as illustrated in FIG. 2 *a*, the stress generated by stirring is exerted concentrically on the individual minute particles 1 because one to a few minute particles 1 are present in the site of exertion of the stress. Further, the individual minute particles 1 adjoin the resin (toner core particle 2) throughout their entire peripheries. Thus, the minute particles 2 are eventually buried readily in the toner core particle 2. In contrast, when charge-controlling minute particles 1 are distributed in a high density locally on the toner core particle 2 as illustrated in FIG. 1*a* and even when the stress arising from stirring happens to be exerted on this site, since the stress is exerted as dispersed to the multiplicity of minute particles 1, the force working on the individual minute particles 1 is weak. Moreover, the minute particles 1 located inside the site of fixation in the high density and parted from the periphery of the site are encircled with adjacent minute particles and, therefore, are sparingly allowed to adjoin the resin, the embedment of the minute particles 1 in the resin occurs only with great difficulty. If this embedment occurs at all, it affects only the minute particles which are located in the peripheral region of the site of fixation in the high density. Specifically, this embedment due to the stress takes place in the same manner as when flat particles of a large surface area are fixed on the surface of the toner core particle 2. Thus, the amount of the charge-controlling substance exposed on the surface of toner particle can be maintained relatively stably.

The electrostatic latent image-developing toner in the first embodiment of the present invention has charge-controlling minute particles fixed on the surface of a toner core particle. The core particle of toner is made of at least a coloring agent and a binder resin. Optionally, it may incorporate therein such toner property-improving agents as offset-preventing agent. When the toner to be finally produced is desired to possess a magnetic property, it is allowed to incorporate a magnetic powder therein.

Of course, the electrostatic latent image-developing toner in the first embodiment of the present invention is allowed to have not only charge-controlling minute particles but also the aforementioned additives externally added and fixed on the surface of core particle. Further, this electrostatic latent image-developing toner of the first embodiment of the present invention is allowed to have a fluidifying agent and other additives externally added and fixed on the surface of core particle.

In the electrostatic latent image-developing toner of the present invention, the core particle has no particular restriction except for the requirement that it should be obtained by any of the conventional methods available for the production of toner particles. These conventional methods include a pulverizing method, wet pelletization methods such as a suspension polymerization method and an emulsion polymerization method which encompass a process of polymerization, and wet pelletization methods such as a suspension method and a spray dry method which encompass no process of polymerization, for example.

To be more specific, the pulverizing method obtains core particles by mixing and blending a coloring agent in a thermoplastic resin, pulverizing the resultant mixture, and classifying the powder consequently formed. Optionally, the core particles thus obtained may be molded in a spherical shape as by means of a heat treatment.

The suspension polymerization method obtains core particles by preparing a polymerization composition having as components thereof a polymerizing monomer capable of forming a resin component as a binder to be described more specifically hereinbelow, a polymerization initiator, a coloring agent, and other additives, suspending the polymerization composition in a non-solvent type medium, and polymerizing the resultant suspension.

Generally, emulsion polymerization barely produces particles which are extremely minute in spite of their ideal particle diameter distribution. The emulsion polymerization method, therefore, is desired to be carried out in the form known as seed polymerization. Specifically, the seed polymerization is carried out by stirring to emulsify part of a polymerizing monomer and a polymerization initiator in an aqueous type medium or an aqueous type emulsifier-containing medium, then gradually adding the remainder of the polymerizing monomer dropwise to the stirred mixture thereby giving rise to minute particles therein, and polymerizing these particles as seeds in the polymerizing monomer liquid drops containing the coloring agent and other additives.

As other wet pelletization methods encompassing a process of polymerization, a soap-free emulsion polymerization method, microcapsulation methods (such as a surface polymerization method and an in-situ polymerization method), and a non-aqueous dispersion polymerization method have been known.

The suspension method produces core particles by dissolving a coloring agent and other additives in a resin component as a binder to be described specifically hereinbelow and suspending the resultant solution in a non-solvent type medium.

The spray dry method produces core particles by dissolving a synthetic resin component in conjunction with a coloring agent in a solvent and then spray drying the resultant solution.

The method for the production of core particles to be used in the electrostatic latent image-developing toner of the present invention, of course, is not limited to the methods cited as examples above.

In the electrostatic latent image-developing toner of the present invention, the synthetic resin forming the core particles need not be particularly restricted but may be selected from among the synthetic resins generally used as a binder. The synthetic resins which are effectively usable herein include thermoplastic resins such as styrene type resins, (meth)acryl type resins, olefin type resins, polyester type resins, amide type resins, carbonate resins, polyethers, and polysulfones, thermosetting resins such as epoxy resin, urea resin, and urethane resin, and copolymers and polymer blends thereof, for example. The binder resins which are usable in the present invention include not only the resins which are in the state of a perfect polymer as in a thermoplastic resin but also the resins which are in the state of an oligomer or a prepolymer as in a thermosetting resin and further include polymers which partially contain a prepolymer, a cross-linking agent, etc., for example.

Recently, a desire has been expressed for a technique which is capable of copying an image at a speed higher than is attainable at present. The toner to be used in such a high-speed system as aimed at is required to permit quick fixation as on a transfer paper and ensure improved separability from a fixing roller. For the purpose of obtaining a toner for use in the high-speed system, therefore, it is desired to use as a binder resin a homopolymer or a copolymer synthesized from a styrene type monomer, a (meth)acryl type monomer, or a (meth)acrylate type monomer or a polyester type resin. The binder resin to be used is desired to be such that the number average molecular weight (Mn), the weight average molecular weight (Mw), and the Z average molecular weight (Mz) satisfy the relations, $1{,}000 \leqq Mn \leqq 7{,}000$, $40 \leqq Mw/Mn \leqq 70$, and $200 \leqq Mz/Mn \leqq 500$ and the number average molecular weight (Mn) falls in the range of $2{,}000 \leqq Mn \leqq 7{,}000$. Where the toner is intended for oilless fixation, the binder resin is desired to have a glass transition point in the range of from 55° to 80° C., a softening point in the range of from 80° to 150° C., and a gelling component content in the range of from 5 to 20% by weight.

For the purpose of obtaining an OHP grade or a full-color grade transparent color toner, it is desired to use as a binder resin a polyester type resin from the standpoints of resistance to vinyl chloride, transparency proper for a transparent color toner, and fast adhesiveness to the OHP sheet. In this case, this binder resin is particularly desired to be a linear polyester which possesses a glass transition point in the range of from 55° to 70° C., a softening point in the range of from 80° to 150° C., a number average molecular weight (Mn) in the range of from 2,000 to 15,000, and a molecular weight distribution (Mw/Mn) of not more than 3. As the binder resin for the production of the transparent color toner, a linear urethane-modified polyester (C) which is obtained by the reaction of a linear polyester resin (A) with diisocyanate (B) can be favorably used. The term "linear urethane-modified polyester" as used herein refers to a linear urethane-modified polyester resin obtained by the reaction of 0.3 to 0.95 mol of diisocyanate (B) with 1 mol of a linear polyester resin which consists of a dicarboxylic acid and a diol, possesses a number average molecular weight in the range of from 2,000 to 15,000 and an acid number of not more than 5, and has the terminal groups thereof formed substantially wholly of hydroxyl groups. The resin (C) has a main component which possesses a glass transition point in the range of from 40° to 80° C. and an acid number of not more than 5. Further, a polymer which is produced by modifying a linear polyester through graft or block copolymerization thereof with an acryl type monomer or an aminoacryl type monomer and which possesses similar glass transition point, softening point, and molecular weight to those mentioned above can be favorably used.

The coloring agent to be contained in the electrostatic latent image-developing toner of the present invention has no particular restriction.

One coloring agent alone or a combination of a plurality of coloring agents may be used. Desirably, the amount of the coloring agent to be used is in the range of from 1 to 20 parts by weight, preferably from 2 to 10 parts by weight, based on 100 parts by weight of the binder resin. If this amount exceeds 20 parts by weight, the toner suffers a sacrifice of the fixing property. Conversely, if this amount falls short of 1 part by weight, the possibility arises that an image will not be obtained with desired density.

When the electrostatic latent image-developing toner of the present invention is to be produced in the form of a transparent color toner, the coloring agent to be contained in this toner may be selected from among various types of pigments and dyes of varying colors known to the art.

These coloring agents may be used either singly or jointly in the form of a combination of a plurality of members. Generally, the amount of the coloring agent to be used is in the range of from 1 to 10 parts by weight, preferably from 2 to 5 parts by weight, based on 100 parts by weight of the binder resin mentioned above. If the amount of the coloring agent exceeds 10 parts by weight, the toner suffers a sacrifice of the fixing property and transparency thereof. Conversely, if this amount falls short of 1 part by weight, the possibility arises that an image will not be obtained with desired density.

The offset-preventing agents which are favorably used herein for improving the fixing property of the toner include various waxes, particularly polyolefin type waxes such as low molecular polypropylene, polyethylene, and oxide type polypropylene and polyethylene, for example.

As a charge-controlling substance to be fixed in the form of minute particles on the surface of the core particle of the aforementioned construction in the electrostatic latent image-developing toner of the first embodiment of this invention, the resin possessing a polar functional group effective in positive or negative charging (CCR) and various inorganic minute particles possessing a charging property are usable as well as the substances generally known as charge-controlling agents (CCA).

The charge-controlling agent (CCA) is not particularly restricted but is only required to be capable of imparting a positive or negative charge through triboelectrification. Various organic and inorganic charge-controlling agents are available.

Examples of the positive charge-controlling agent are Nigrosine Base EX (proprietary product of Orient Chemical Industry Co., Ltd.), Quaternary Ammonium Salt P-51 (proprietary product of Orient Chemical Industry Co., Ltd.), and Nigrosine Bontron N-01 (proprietary product of Orient Chemical Industry Co., Ltd.) and examples of the negative charge-controlling agent are oil black (Color Index 26 150), Oil Black BY (proprietary product of Orient Chemical Industry Co., Ltd.), Bontron S-22 (Orient Chemical Industry Co., Ltd.), Metal Complex of Salicylic Acid E-81 (proprietary product of Orient Chemical Industry Co., Ltd.), thio-indigo type pigments, sulfonyl amine derivative of copper phthalocyanine, Spiron Black TRH (proprietary product of Hodogaya Chemical Co., Ltd.), and Bontron S-34 (proprietary product of Orient Chemical Industry Co., Ltd.).

When these charge-controlling agents in the form supplied as commercial products have too large particle diameters to be properly used for the toner of the present invention, they may be adjusted to a proper particle diameter to be described specifically hereinbelow by being subjected either in their simple form or as dispersed in a binder such as of resin to a treatment with a jet mill, for example. Further, the charge-controlling agents which are wet pulverized or dissolved in water or an organic solvent may be suitably used.

The charge-controlling resins (CCR) effectively usable herein include various resins possessing polar functional groups which are effective in positive or negative charging. Among these charge-controlling resins, polymers which possess a monomer component containing such a nitrogen-containing polar functional group as shown below or a fluorine atom prove to be particularly desirable. The charge-controlling resin (CCR) may be a homopolymer of a monomer possessing a polar functional group or a copolymer of two or more such monomers, a copolymer of a monomer component possessing a polar functional group with a monofunctional and/or polyfunctional monomer such as, for example, a styrene type monomer or (meth)acryl type monomer, or a polymer blend between a polymer of a monofunctional and/or polyfunctional monomer and a polymer containing a monomer possessing a polar functional group.

The nitrogen-containing polar functional group is effective in controlling a positive charge. Among the monomers possessing a nitrogen-containing polar functional group are counted amino (meth)acryl type monomers represented by the following general formula (I):

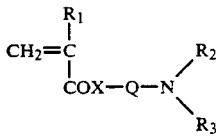

(I)

(wherein $R_1$ stands for a hydrogen atom or a methyl group, $R_2$ and $R_3$ independently stand for a hydrogen atom or an alkyl group of 1 to 20 carbon atoms, X stands for an oxygen atom or a nitrogen atom, and Q stands for an alkylene group or an allylene group). When the charge-controlling resin contains such an amino group-containing monomer as mentioned above, the content thereof is desired to be in the range of from 0.5 to 90% by weight, preferably from 3 to 60% by weight, based on the total amount of all the monomers present in the resin. Among the monomers possessing a nitrogen-containing polar functional group are counted nitro group-containing monomers represented by nitro-styrene, for example. When the charge-controlling resin contains such a nitro group-containing monomer as mentioned above, the content thereof is desired to be in the range of from 0.5 to 50% by weight, preferably from 1 to 30% by weight, based on the total amount of all the monomers present in the resin.

The fluorine atom is effective in controlling a negative charge. The fluorine-containing monomer is not particularly limited. The fluorine-containing monomers which are favorably usable herein include fluoroalkyl (meth)acrylates such as 2,2,2-trifluoroethyl acrylate, 2,2,3,3-tetrafluoropropyl acrylate, 2,2,3,3,4,4,5,5-octafluoroamyl acrylate, and 1H, 1H, 2H, 2H-heptadecafluorodecyl acrylate, for example. Besides, trifluorochloroethylene, vinylidene fluoride, ethylene trifluoride, ethylene tetrafluoride, trifluoropropylene, hexafluoropropene, and hexafluoropropylene are also usable. When the charge-controlling resin contains such a fluorine-containing monomer, the content thereof is desired to be in the range of from 0.5 to 50% by weight, preferably from 1 to 30% by weight, based on the total amount of all the monomers present in the resin. The inorganic compounds possessing a charge-controlling property and proving usable as charge-controlling minute particles in the electrostatic latent image-developing toner of the first embodiment of the present invention include fluorides such as magnesium fluoride and carbon fluoride, silicates such as anhydrous silicon dioxide, aluminum silicate, and magnesium silicate which are produced by a dry method or a wet method, and titanium dioxide, alumina, calcium carbonate, barium titanate, and zinc oxide, and mixtures thereof, for example. In these inorganic compounds, those which have a low charging property may have a negatively charging polar group and/or a positively charging polar group bound to the surface of minute particles thereof for the sake of convenience of use. This impartation of the polar group is accomplished by treating the minute particles with a coupling agent containing the polar group.

The coupling agents possessing a negatively charging polar group include fluorine type silane coupling agents such as $CF_3(CH_2)_2SiCl_3$, $CF_3(CF_2)_5SiCl_3$, $CF_3(CF_2)_5(CH_2)_2SiCl_3$, and $CF_3(CH_2)_2Si(OCH_3)_3$, for example. These coupling agents may be used either singly or jointly in the form of a mixture of two or more members.

The coupling agents possessing a positively charging polar group include amine type coupling agents such as $H_2N(CH_2)_2NH(CH_2)_3Si(OCH_3)_3$, $H_2N(CH_2)_2NH(CH_2)_3Si(CH_3)(OCH_3)_2$, and $H_2N(CH_2)_2NH(CH_2(_3Si)OCH_3)_3$, for example. These coupling agents may be used either singly or jointly in the form of a mixture of two or more members.

In the surface treatment of inorganic minute particles by the use of a coupling agent possessing such a polar group as mentioned above, it is naturally permissible to use either a coupling agent possessing a positively charging polar group or a coupling agent possessing a negatively charging polar group alone. Optionally, these two coupling agents may be simultaneously used in the surface treatment for the union of both positive and negative polar groups to the inorganic minute particles. When the inorganic minute particles resulting from the surface treatment with the coupling agent is intended to be used as a negatively charging toner, however, the amount of a coupling agent containing a positively charging polar group and that of a coupling agent containing a negatively charging polar group to be used are desired to be adjusted so that the fluorine atom as one of the constituent atoms of the coupling agent bound to the surface of inorganic minute particles will be contained in a larger amount that the nitrogen atom. Specifically, this adjustment is desired to be effected by treating the inorganic minute particles with the coupling agents so that the treated inorganic minute particles will have a fluorine atom content in the range of from 2.0 to 6.0% and a nitrogen atom content in the range of from 0.04 to 0.2%. When the inorganic minute particles obtained in consequence of the treatment with the coupling agents is intended for a positively charging toner, the amounts of the aforementioned coupling agents to be used are similarly desired to be adjusted so that the fluorine atom as one of the constituent atoms of the coupling agent bound to the surface of inorganic minute particles will be contained in a larger amount than the nitrogen atom. Specifically, this adjustment is desired to be effected by treating the inorganic minute particles with the coupling agents so that the treated inorganic minute particles will have a fluorine atom content in the range of from 0.005 to 0.2% and a nitrogen atom content in the range of from 2.0 to 5.0%.

The inorganic minute particles possessing such a charging property as mentioned above and used as charge-controlling minute particles are desired to have undergone a treatment for impartation of hydrophobicity so as to curb changes of properties due to environmental conditions, particularly humidity. This treatment is highly effective for the purpose. The agents which are effectively usable for the treatment include various coupling agents of the silane type, titanate type, aluminum type, and zircoaluminate type, for example.

Various compounds mentioned above are available for the charge-controlling minute particles to be fixed on the surface of core particles in the electrostatic latent image-developing toner of the first embodiment of this invention. The volume average particle diameter of the minute particles ($d_{CCA}$) is required to satisfy the relation, $d_{CCA} \leqq d_{TONER}/20$, preferably the relation, $d_{TONER}/100 \leqq d_{CCA} \leqq d_{TONER}/20$, wherein $d_{TONER}$ stands for the area average particle diameter of the toner. If the volume average particle diameter of the charge-controlling minute particles ($d_{CCA}$) is larger than 1/20 of the area average particle diameter of the toner ($d_{TONER}$), the number of charge-controlling minute particles to be fixed per toner particle is unduly small. Only a slight change in the number of these particles to be fixed opens up a very great possibility of dispersing the weight of charge-controlling substance to be fixed among the individual toner particles and widening the charge distribution. As described above, the size of the charge-controlling minute particles to be used in the present invention hinges heavily on the size of the toner particles desired to be obtained and is not particularly restricted but is only required to satisfy the relation mentioned above. To be specific, the volume average particle diameter is required to be less than 1 μm, desirably to be in the range of from 0.001 to 0.5 μm, preferably from 0.005 to 0.5 μm. Where the charge-controlling minute particles are made of a charge-controlling agent (CCA) or a charge-controlling resin (CCR) such as described above, the volume average particle diameter thereof is desired to be in the range of from 0.01 to 1 μm, preferably from 0.05 to 0.5 μm. Where the charge-controlling minute particles are such inorganic minute particles as described above, the volume average particle diameter thereof is desired to be in the range of from 0.001 to 0.1 μm, preferably from 0.005 to 0.05 μm.

In the electrostatic latent image-developing toner of the first embodiment of the present invention, such charge-controlling minute particles as described above which are externally added to the core particles are fixed in a high density locally on the surface of the core particles. The charge-controlling minute particles to be fixed on the surface of core particles of the electrostatic latent image-developing toner of the present invention have a very small size such as not to exceed 1/20 of the size of the core particles as described above. If these particles are uniformly dispersed instead of being distributed in a high density locally, most of these charge-controlling minute particles are embedded into the toner particles in consequence of protracted stirring, with the result that the amount of the charge-controlling substance allowed to function effectively is decreased and the charge-controlling property is not manifested stably for a long time.

The locally densified distribution of the charge-controlling minute particles mentioned above is desired to fulfill the condition that the area in which the fixation density (D) of the charge-controlling minute particles on the surface of core particles is not less than 1.5 times the average fixation density should account for a proportion of not less than 20% of the entire surface of core particles, preferably the area in which the fixation density is not less than 2.0 times the average fixation density should account for a proportion of not less than 30% of the entire surface of core particles.

The amount of the charge-controlling minute particles to be added, though variable with the magnitude of the charging property of the charge-controlling minute particles, is required to be in the range of from 0.001 to 10 parts by weight, desirably in the range of from 0.1 to 5 parts by weight, and more desirably from 0.2 to 3 parts by weight. If the amount of the charge-controlling minute particles to be added exceeds 10 parts by weight, based on 100 parts by weight of core particles, the possibility arises that the absolute value of the magnitude of the triboelectricity will unduly increase and images of high density will be obtained only with difficulty. Conversely, if the amount of this addition is less than 0.001 part by weight, the possibility ensues that the charge-controlling property will be insufficient, sufficient charging particularly in a highly humid environment will consume time, and toner particles adhering to the part other than the latent image by a force other than the electrical force will not be expelled but suffered to smear an image.

The fixation of the charge-controlling minute particles on the surface of core particles in such a locally densified manner as described above can be accomplished, for example, by using a device utilizing the wet coating method such as Dispercoat (a proprietary product of Nissei Engineering Co., Ltd.) or Coatmizer (a proprietary product of Freunt Sangyo K.K.) and adopting a liquid immersion method which comprises causing a powder conveyed as dispersed by a high-speed current of air to collide against a wall surface on which a liquid medium is flowing down and establishing contact of the power with the liquid medium. Specifically, the locally densified fixation is effected by dissolving or dispersing the charge-controlling minute particles in the liquid medium, decreasing the flow volume of the liquid medium, consequently wetting part of the surface of the powder (core particles), and thereafter expelling the liquid medium by drying and consequently allowing the charge-controlling minute particles to adhere to and remain on the aforementioned site.

Otherwise, the locally densified fixation of the charge-controlling minute particles can be attained by causing the core particles obtained as described above to gather into clusters of a proper size without inducing appreciable loss of their individual shape or thorough fusion or solution of the core particles, causing the charge-controlling minute particles to be fixed uniformly and densely on the surface of the cluters by the use of a surface-modifying device heretofore adopted for adhesion and/or fixation of minute particles of various additives on the surface of toner particles such as, for example, a device utilizing the high-speed air current collision method such as Hybridization System (proprietary product of Nara Kikai Seisakusho K.K.) or Cosmos System (proprietary product of Kawasaki Jukogyo Kabushiki Kaisha), a device utilizing the dry mechanochemical method such as Mechanofusion System (proprietary product of Hosokawa Micron K.K.) or Mechanomill (proprietary product of Okada Seikosha K.K.), a device utilizing the hot air current modification method such as Suffusing System (proprietary product of Nippon Pneumatic Kogyo K.K.), or a device utilizing the aforementioned wet coating method, and causing the clusters having the charge-controlling minute particles fixed uniformly and densely on the surface thereof to be disintegrated into toner particles thereby inducing fixation of the charge-controlling minute particles only on the parts of the particles corresponding to the former surface parts of the clusters. When the core particles are produced by the pulverization method, this production may be effected by coarsely grinding a mass of the toner composition into lumps of a suitable size, then causing the charge-controlling minute particles to be fixed uniformly and densely by the use of the device mentioned above on the surface of the lumps, and thereafter finely pulverizing the lumps having the charge-controlling minute particles fixed uniformly and densely on the surface thereof.

The method for the production of the electrostatic latent image-developing toner of the present invention need not be limited at all to the methods described above but may be selected from among the methods which are capable of producing toner particles having prescribed charge-controlling minute particles fixed in a high density locally as described above.

Second embodiment: addition of minute particles of fluidifying agent

Figure 3:
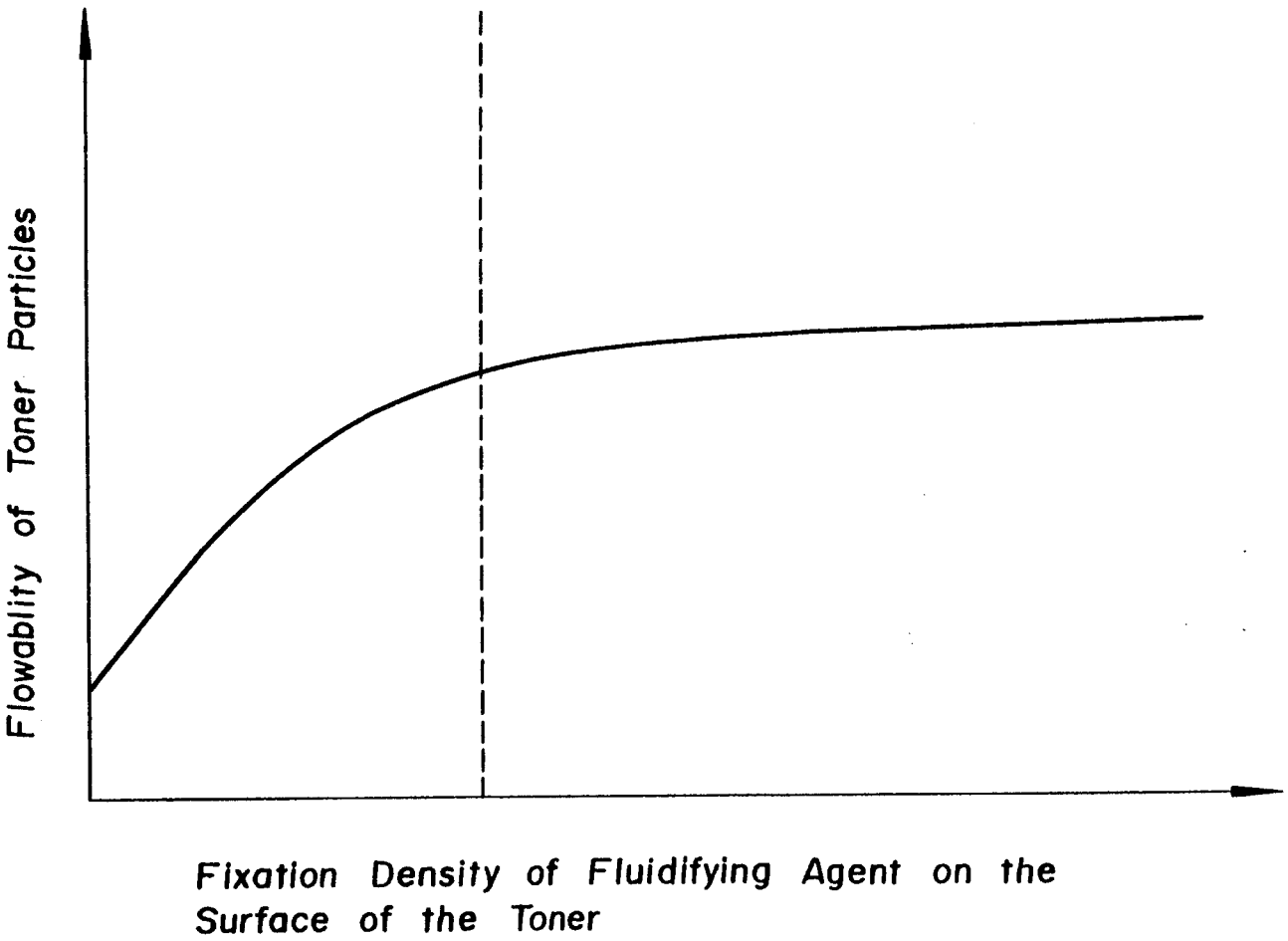
FIG. 3 is a graph showing in type the relation between the fixation density of a fluidifying agent on the surface of the toner and the flowability of toner particles.

In the external addition of a fluidifying agent to the electrostatic latent image-developing toner, when the amount of addition of the fluidifying agent is increased and the density of the fluidifying agent attached to and/or fixed on the surface of toner particles (hereinafter this state of attachment and/or fixation will be referred to briefly as "fixation") is increased, the flowability of the toner is increased in consequence of the addition to the density of fixation to a certain degree and the improvement in the flowability virtually ceases and levels off after the density of fixation of the fluidifying agent reaches a certain value as illustrated by a type diagram of FIG. 3. As a result, when the initial fixation density of the fluidifying agent which has a value falling in or near the slanted part of the curve of FIG. 3 is lowered by the liberation of the fluidifying agent from the toner particles or the embedment of the fluidifying agent in the toner particles in consequence of protracted stirring, a conspicuous decrease occurs in the flowability of toner particles. Conversely, when the fluidifying agent is fixed in an amply high density, virtually no decrease of the flowability is observed in spite of a decline in the density due to protracted stirring. The dependency of the charging property on the environment gains in degree when the total amount of the fluidifying agent is increased.

By having the fluidifying agent fixed in a high density locally on the surface of toner particles and allowing the fixed fluidifying agent to be gradually liberated by stirring from the site of fixation, therefore, a change of density in the site of locally densified fixation has virtually no effect on the flowability of toner particles, the amount of the fluidifying agent to be decreased in consequence of the liberation or embedment of the fluidifying agent in the other part is reprelished by the fluidifying agent liberated from the site of locally densified fixation, the amount of the fluidifying agent is retained constant without reference to the duration of stirring, and the flowability of toner particles is no longer degraded by protracted stirring. Further, by locally limiting the cite for the presence of the fluidifying agent in a high density, the otherwise possible deterioration of the dependency of the toner's charging property on the environment by the addition of the fluidifying agent in a large amount can be curbed to the minimum.

The toner core particles to be used for the electrostatic latent image-developing toner of the second embodiment of the present invention may be the same as those described above with respect to the first embodiment of the present invention.

The fluidifying agent to be externally added to the core particles is not particularly restricted. The fluidifying agents which are effectively usable herein include various carbides such as silicon carbide, boron carbide, titanium carbide, and zirconium carbide, various nitrides such as boron nitride, titanium nitride, and zirconium nitride, borides such as zirconium boride, various oxides such as aluminum oxide, titanium oxide, iron oxide, chromium oxide, calcium oxide, magnesium oxide, zinc oxide, copper oxide, and silica, sulfides such as molybdenum sulfide, fluorides such as magnesium fluoride and carbon fluoride, various metallic soaps such as aluminum stearate, calcium stearate, zinc stearate, and magnesium stearate, various inorganic minute particles such as talc and bentonite, and various organic minute particles such as styrene type, (meth)acryl type, olefin type, fluorine-containing type, and nitrogen-containing (meth)acryl type, silicon, benzoguanamine, and melamine produced by such wet polymerization methods as emulsion polymerization method, soap-free emulsion polymerization method, and non-aqueous dispersion polymerization method, and a gaseous-phase method, for example. Among the fluidifying agents cited above, silica, aluminum oxide, titanium dioxide, and magnesium fluoride prove to be desirable. Colloidal silica is further desirable. For the purpose of stabilizing the charging property of the toner particles to resist moisture, the fluidifying agent is desired to have undergone a treatment for impartation of hydrophobicity.

As respects the size of the fluidifying agent, the average particle diameter thereof is required to be not more than 1 μm, desirably to be in the range of from 0.001 to 0.1 μm, and more desirably to be in the range of from 0.005 to 0.05 μm.

These fluidifying agents may be used either singly or jointly in the form of a combination of a plurality of members. It is further permissible to use a combination of a plurality of such fluidifying agents differing in particle diameter.

In the electrostatic latent image-developing toner of the second embodiment of the present invention, the fluidifying agent to be externally added to the core particles of such a construction as described above is present in a high density locally on the surface of the core particles. The state of such locally densified distribution of the fluidifying agent as described above is desired particularly to satisfy the condition that the area in which the fixation density (D) of the fluidifying agent on the surface of core particles is not less than 1.5 times the average value of D accounts for a proportion of not less than 20% of the entire surface of core particles, preferably that the area in which the fixation density is not less than 2.0 times the average value of D accounts for a proportion of not less than 30% of the entire surface of core particles. Where two or more fluidifying agents different in average particle diameter are used for the external addition, it is necessary that at least the fluidifying agent of the smallest particle diameter should be fixed in a high density locally as described above. This is because, during the stirring of the toner particles, the ease with which the fluidifying agent is embedded in the surface of the core particles increases with the decreasing average particle diameter.

Further, the state in which substantially no fluidifying agent is present in the part other than the site for the presence of the fluidifying agent in a high density is not inconceivable. In the state of this nature, the initial flowability of the toner is possibly degraded unless the toner particles have a very closely spherical shape and the manner of supply of the toner to the developing device does not require the toner to possess very high flowability. It is generally desirable, therefore, that the fluidifying agent should be present to some extent in the part other than the site for the presence of the fluidifying agent in a high density.

The total amount of the fluidifying agent to be added is desired to be in the range of from 0.1 to 10 parts by weight, preferably from 0.3 to 5 parts by weight, and more preferably from 0.3 to 2 parts by weight, based on 100 parts by weight of the core particles. if the amount of the fluidifying agent to be added exceeds 10 parts by weight, based on 100 parts by weight of core particles, the possibility that the stability of the toner's charging capacity to resist moisture will be degraded is great even when the locally densified distribution of the fluidifying agent on the surface of core particles is satisfactory. Conversely if the amount of the fluidifying agent to be added is less than 0.1 part by weight, the flowability of the toner cannot be stably maintained for a long time.

In the state in which the local site for presence of the fluidifying agent in a high density is formed on the surface of toner particles and yet virtually no fluidifying agent is present on the part other than the local site, it is desirable from the standpoint of securing such ideal initial flowability as described above that the particles resulting from the aforementioned treatment should be further subjected to a treatment of stirring with the added fluidifying agent as generally practiced so as to enable a very small amount of the fluidifying agent to be uniformly deposited on the part other than the aforementioned site. During the operation of the treatment of stirring with the added fluidifying agent, the amount of the fluidifying agent to be added to the site of treatment is in the range of from 0.1 to 2 parts by weight, preferably 0.1 to 1 part by weight, based on 100 parts by weight of the core particles. The amount of the fluidifying agent to be added during the treatment of local fixation is the difference of subtraction of the amount of the fluidifying agent added during the treatment of stirring from the total amount of the fluidifying agent mentioned above (0.1 to 10 parts by weight, based on 100 parts by weight of the core particles).

The method to be employed for the attachment and/or fixation of the minute particles of the fluidifying agent on the surface of the core particles in the present embodiment may be the same as that described with respect to the first embodiment.

Third embodiment: addition of non-insulating minute particles

The toner particles which have been triboelectrified and conveyed as electrostatically or magnetically restrained by means of carrier particles or a developing sleeve, at the moment of their collision against the latent image on the photosensitive material during the step of development, behave like free particles momentarily and produce a rolling or rotating motion on the surface of the photosensitive material. The toner particles are then electrostatically deposited on the surface of the latent image. During the motion of the toner particles resembling that of free particles, the non-insulating minute particles locally fixed on the surface of the toner particles accept electric charge from the surface of the latent image and the toner particles located at this site adhere to the latent image and then exhibit a potential close to that of the latent image. As a result, a site possessing the potential approximating that on the surface of latent image is formed on the surface of the toner particles deposited on the latent image. Thus, toner particles are superposed on toner particles eventually to effect deposition of a plurality of layers of toner particles on the latent image and increase the density of the image.

In contrast, during the step of transfer, the toner particles are nipped between the photosensitive material and the transfer material such as paper and consequently prevented from producing a free rotating motion. In the electrostatic latent image-developing toner of the present invention, since the non-insulating minute particles fixed on the surface of toner particles are present only locally and the site of this local presence is not continued through the entire surface of the toner particles, the phenomenon that the electric charge flows away on the surface of toner particles during the step of electrostatic transfer in which the toner particles remain in the static state as described above and the transfer property of the toner particles is retained intact.

The core particles to be used for the electrostatic latent image-developing toner of the third embodiment of the present invention may be the same as those described above with respect to the first embodiment.

The non-insulating substance which is fixed in the form of minute particles on the surface of core particles is not particularly restricted but is only required to be capable of accepting an electric charge from the surface of the latent image and consequently acquiring a potential close to that of the surface of the latent image during the rolling or rotating motion of the toner particles on the latent image of the photosensitive material. This substance is desired to possess a volume intrinsic resistance of not more than $10^{10}\Omega\cdot$cm, preferably not more than $10^{8}\Omega\cdot$cm. The substances which are effectively usable herein include powders of metals or metal alloys such as aluminum, zinc, iron, copper, nickel, silver, palladium, and stainless steel, minute resin particles furnished with such metallic coats as aluminum coat, nickel coat, and silver coat, carbon powders such as of acetylene black and Ketjen black, and metallic compounds such as tin oxide and titanium dioxide, for example. Besides, magnetic powders such as magnetite, gamma-hematite, and various species of ferrite are available.

As respects the size of such non-insulating minute particles as described above, the average particle diameter is desired to be not more than 1 μm, preferably not more than 0.5 μm. When the non-insulating substance is added to the surface of toner particles, the charging characteristics of the toner are greatly affected by the amount of the non-insulating substance exposed on the surface of the toner particles. If the non-insulating minute particles to be used have a relatively large average particle diameter such as to exceed 1 μm, the number of non-insulating minute particles fixed on each toner particle is small and only a small change in the number of minute particles so fixed results in dispersion of the weight of the non-insulating substance among the toner particles and variation of the charging characteristics of the toner.

In the electrostatic latent image-developing toner of the third embodiment of the present invention, such non-insulating minute particles as described above which are externally added to the core particles are locally fixed on the surface of the core particles. When the triboelectrified toner is attached as described above to the surface of the latent image on the photosensitive material, the toner particles instantaneously behave after the manner of free particles and produce a rolling or rotating motion. When the non-insulating minute particles have been fixed in advance on the surface of the core particles, therefore, the non-insulating minute particles accept an electric charge from the surface of the latent image and, on fast contact with the surface of the latent image, exhibit a potential approximating that of the surface of the latent image so as to allow adhesion of other toner particles to the formerly deposited toner particles and increase the density of development. If the non-insulating minute particles are uniformly fixed throughout the entire surface of the core particles, however, the toner is suffered to manifest electroconductivity and the transfer field is consequently prevented from being sufficiently delivered during the step of transfer and the transfer of the image by the Coulomb attraction is attained only with difficulty. This is why the local fixation is required. The non-insulating minute particles are fixed as described above on the surface of the core particles in the electrostatic latent image-developing toner of the third embodiment of the present invention. Since the non-insulating minute particles are locally distributed, however, the toner particles statically behave as an insulator.

Since the non-insulating minute particles fixed on the surface of the core particles, though very small, are locally present on the surface as described above, they manifest the function stably for a long time while encountering only sparingly the phenomenon that the non-insulating minute particles are buried into the toner particles owing to protracted stirring and the amount of the non-insulating substance allowed to function effectively is decreased as observed where these minute particles are distributed in a dispersed manner.

Incidentally, the state of local distribution of the non-insulating minute particles described above is desired particularly to satisfy the condition that the area in which the fixation density (D) of the non-insulating minute particles on the surface of core particles is not more than 50% of the average value of D should account for a proportion of not less than 20% of the entire surface of core particles, preferably that the area in which the fixation density is not more than 30% of the average value of D should account for a proportion of not less than 30% of the entire surface of core particles.

The amount of the non-insulating minute particles to be added, though variable as with the kind of the non-insulating minute particles, is desired to be in the range of 0.1 to 10 parts by weight, preferably from 0.5 to 5 parts by weight, based on 100 parts by weight of the core particles. If the amount of the non-insulating minute particles to be added exceeds 10 parts by weight based on 100 parts by weight of the core particles, the possibility that the toner particles statically will manifest electroconductivity and the transfer property of the toner will be degraded is high even when the non-insulating minute particles are locally distributed. Conversely, if the amount of addition is less than 0.1 part by weight, the possibility that the image density will not be sufficient is high because the part equaling in potential the surface of latent image is not formed sufficiently on the surface of the latent image and the deposition of a plurality of layers of toner is not obtained on the surface of the latent image.

The method to be employed for the deposition and/or fixation of the non-insulating minute particles to the surface of core particles in the present embodiment may be the same as described above with respect to the first embodiment.

Optionally, in the electrostatic latent image-developing toner of the third embodiment of the present invention, other additives such as a fluidifying agent may be externally added in the form of minute particles and deposited or fixed on the surface of core particles in addition to the non-insulating minute particles described above. These other additives used in the form of minute particles are desired to show an insulating property and to be uniformly added to the surface of core particles. When such minute particles of other additives as described above are possessed of an insulating property, these minute particles enable themselves to manifest fully the function inherent therein, allow the part of the surface of toner particles (the part in which the presence of the non-insulating minute particles is sparse) other than the part seating the non-insulating minute particles in a locally distributed manner (the part in which the presence of the non-insulating minute particles is dense) to acquire an insulating property with enhanced certainty, enable the separate portions of the part allowing dense presence of the non-insulating minute particles to enjoy mutual independence significantly, and allow the toner particles as a whole to retain an insulating property with added certainty.

Fourth embodiment: addition of magnetic minute particles

In the electrostatic latent image-developing toner of the fourth embodiment of the present invention, magnetic minute particles are locally distributed on the surface of toner particles and the site of the local distribution, as a natural consequence, possesses higher magnetic properties than the part other than the site, namely the part in which the fixation density of magnetic minute particles is low or nil. The drift of toner particles outside the developing device is caused by the fact that toner particles are liberated in the area of development from carrier particles and are then released into the ambient air. When an area of a strong magnetic property is present at all in part of the surface of toner particles, therefore, the toner particles in this part are retained on the surface of carrier particles in the direction in which they contact the carrier particles and, as a result, they are liberated from the carrier particles only with added difficulty. The toner, accordingly, fits high-speed development fully satisfactorily.

Further, since the magnetic minute particles are locally added to the surface of toner particles as described above, the electroconductivity of the surface of toner particles is not augmented by the magnetic minute particles in use even when these magnetic minute particles are made of a substance of low electric resistance and, as a result, the toner is enabled to retain an insulating property statically. During the electrostatic transfer, therefore, the transfer property of the toner is retained infallibly because such phenomena as flow of electric charge on the surface of toner particles cannot occur. Owing to this retention of the insulating property of the toner, neither the edge effect is enervated nor the image quality is degraded. Further, in the present invention, since the magnetic minute particles are added on the surface of toner particles and locally, the minimum consumption of these particles suffices to obtain the expected effect and the particles have no conspicuous effect on the fixing property.

The toner core particles to be used for the electrostatic latent image-developing toner of the fourth embodiment of the present invention may be the same as those described above with respect to the first embodiment of the present invention.

The magnetic substance which is fixed in the form of minute particles on the surface of core particles is not particularly restricted but selected from among well-known substances. When the toner is to be obtained in black, for example, magnetite (triiron tetraoxide) which is black in itself and manifests the function of a coloring agent is favorably used. For the production of a color toner, a coloring agent such as metallic iron which has a low blackish hue can be used. Typical magnetic substances or magnetizable materials include such metals as cobalt, iron, and nickel which exhibit ferromagnetism, alloys, mixtures, and oxides of such metals as aluminum, cobalt, iron, lead, magnesium, nickel, zinc, antimony, beryllium, bismuth, cadmium, calcium, manganese, selenium, titanium, tungsten, and vanadium, and sintered substances (ferrite), for example. These materials are used either in a simply pulverized form or in a form pulverized and dispersed in a binder such as of resin.

As respects the size of these magnetic minute particles, the average particle diameter thereof is desired to be not more than 2 μm, preferably not more than 1 μm and more preferably not more than 0.5 μm. When a magnetic substance is added to the surface of toner particles, the magnetic property and the surface electroconductivity of the toner are conspicuously affected by the amount of the magnetic substance fixed on the surface of toner particles. If the magnetic minute particles to be used have a relatively large average particle diameter such as to exceed 2 μm, the number of the magnetic minute particles fixed on each toner particle is so small that even a slight change in the number of such fixed magnetic minute particles results in dispersion of the weight of the fixed magnetic substance among the individual toner particles and addition to the ranges of distribution of the toner's magnetic properties and surface electroconductivity.

In the electrostatic latent image-developing toner of the fourth embodiment of the present invention, the magnetic minute particles which are externally added as described above to the core particles are locally distributed so that the amount of the magnetic minute particles required for impartation of an effective magnetic property (orientation) may be minimized and the electric resistance of the surface of toner particles may be prevented from being degraded by the added magnetic minute particles.

The state of local distribution of these magnetic minute particles is desired particularly to satisfy the condition that the area in which the fixation density (D) of the magnetic minute particles on the surface of core particles is not less than 1.5 times the average value of D accounts for a proportion of not less than 20% of the entire surface of core particles and the area in which the fixation density is not more than 50% of the average value of D accounts for a proportion of not less than 20% of the entire surface of core particles, preferably that the area in which the fixation density is not less than 2.0 times the average value of D accounts for a proportion of not less than 30% of the entire surface of core particles and the area in which the fixation density is not more than 30% of the average value of D accounts for a proportion of not less than 30% of the entire surface of core particles.

The conventional insulating non-magnetic toner is triboelectrified by being stirred with a carrier and, owing to the electrostatic force consequently generated, bound with the toner. In the electrostatic latent image-developing toner of the present invention, owing to the local distribution of the magnetic minute particles on the surface of core particles and the consequent manifestation of a high magnetic property in the site of the local distribution besides the electrostatic force mentioned above, the toner particles are retained fact on the surface of carrier particles by the magnetic force exerted in the direction of contact thereof with the toner particles and, as a result, the toner particles are not liberated from the carrier particles even by an increase of a mechanical external force and not easily scattered outside the developing device. Since the magnetic minute particles are locally distributed on the surface of core particles as described above, such phenomena as generation of electroconductivity in the toner due to low electric resistance of the magnetic minute particles, obstruction of the transfer by Coulomb attraction, and degradation of image quality by a lowered edge effect are precluded.

Since such magnetic minute particles as described above which are extremely small and are fixed on the surface of core particles are locally distributed, they manifest the expected function stably for a long time while only sparingly encountering the phenomenon that most magnetic minute particles are embedded in the toner particles owing to protracted stirring and the amount of the magnetic substance allowed to function effectively is decreased as observed when the minute particles are distributed in a dispersed manner.

The amount of the magnetic minute particles to be added, though variable with the kind of the magnetic minute particles, is desired to be in the range of from 0.1 to 10 parts by weight, preferably from 0.5 to 5 parts by weight, based on 100 parts by weight of the core particles. If the amount of the magnetic minute particles to be added exceeds 10 parts by weight, based on 100 parts by weight of the core particles, the possibility that the toner particles will statically exhibit electroconductivity and the transfer property and the image quality will be impaired is high even when the magnetic minute particles are locally distributed. Conversely, if the amount of addition is less than 0.1 part by weight, the possibility that an area possessing a sufficiently high magnetic property will not be formed on the surface of toner particles and the force with which the toner particles are bound to the carrier particles will not be improved is high.

The method to be employed for the attachment and/or fixation of the magnetic minute particles on the surface of core particles in the present embodiment may be the same as that described above with respect to the first embodiment.

In the electrostatic latent image-developing toner of the fourth embodiment of the present invention, since the magnetic minute particles are locally distributed on the surface of core particles, the toner particles tend to undergo cohesion and consequently impair the flowability of the toner and possibly pose an obstruction in the way of supply of the toner particles from the toner bottle. In the electrostatic latent image-developing toner of the fourth embodiment of the present invention, therefore, it is desirable for the sake of improvement of the flowability of the toner to have a fluidifying agent externally added to the surface of toner particles and attached to or fixed on the surface of core particles in the same manner as when the conventional toner is subjected to an aftertreatment. This fluidifying agent is desired to possess not only a non-magnetic property but also an insulating property and to be added uniformly to the surface of core particles. When these minute particles of other additives are of an insulating type, they are allowed to manifest the function of imparting flowability to the toner, ascertain positively the insulating property of the part of the surface of toner particles (the part of sparse presence of magnetic minute particles) other than the part in which the magnetic minute particles are locally distributed (the part of dense presence of magnetic minute particles), establish mutual independence significantly among the parts of dense presence of magnetic minute particles, and ensure the insulating property of the whole toner particles definitely.

Fifth embodiment: addition of minute particles for improving cleanability

The poor cleanability of spherical toner particles is ascribable mainly to the fact that when the toner particles remaining on the surface of a photosensitive material after the steps of development and transfer are to be removed with a cleaning blade, the spherical toner particles which inherently have high rollability are readily rolled and not easily separated from the surface of the photosensitive material by the contact with the leading end of the cleaning blade and, by virtue of inertia, are suffered to slip through the gap between the blade and the surface of the photosensitive material. The present inventors have taken a special notice of this fact and consequently conceived an idea of fixing and/or attaching minute particles locally on the surface of spherical toner particles. When the minute particles are fixed and/or attached locally on the surface of the spherical toner particles as described above, the rollability of the spherical toner particles is degraded and the cleanability thereof is enhanced because the "undulation" of irregularities of protuberance on the surface of the spherical toner particles is larger than when the minute particles are fixed and/or attached uniformly on the surface of spherical toner particles. There are times when the obstruction of rotation of the toner particles by such surface irregularities as described above may possibly cause the toner particles to be pressed against the surface of the photosensitive material by the blade. In this case, since the "undulation" of irregularities of protuberance on the surface of toner particles is large as described above, since the protuberances formed by the local presence of minute particles function to obstruct the rotation of toner particles, and since the spherical toner particles pressed against the surface of the photosensitive material contact the surface of the photosensitive material predominantly through the surface of the spherical toner particles themselves and sparingly through the medium of minute particles, the possibility that stress will be concentrated on the minute particles is nil, the possibility that the minute particles will be fused to the photosensitive material and the minute particles will inflict injuries on the photosensitive material is remote, and the possibility that adverse effects will be produced on the durability of the device is absent. As respects the fixability of the toner, since the amount of minute particles to be added for enhancing the cleanability as described above is minimized by having the minute particles distributed locally, the possibility that use of minute particles possessing thermal properties enough to preclude their thermal fusion to the surface of the photosensitive material will degrade the strength of fixation of the toner is remote. Further since the minute particles to be added for the purpose of improving the cleanability are distributed locally as described above, such characteristic properties as electric charging property, environmental stability, flowability, transferability, and electroconductivity which hinge heavily on the surface attributes can be easily controlled.

The core particles to be used for the electrostatic latent image-developing toner of the fifth embodiment of the present invention may be constructed in the same manner as those described above with respect to the first embodiment, excepting the condition that they should be in a spherical shape is to be additionally fulfilled. When the pulverizing method is adopted among other methods cited above for the production of core particles, the produced core particles generally assume an indefinite shape. By subjecting the particles so obtained to a suitable treatment such as a heat treatment which is capable of sphering such particles of an indefinite shape, the spherical core particles which are aimed at by the present embodiment can be formed.

The minute particles to be fixed and/or attached on the surface of core particles for the purpose of improving the cleanability as described above are not particularly restricted by selected from among various inorganic minute particles or various organic minute particles which may be used either singly or jointly in the form of a combination of two or more members. Among these minute particles cited above, silica, fluorine-containing type resins, and styrene-(meth)acryl type resins prove to be particularly desirable.

As respects the size of such organic or inorganic minute particles as added for the purpose of improving the cleanability as described above, the average particle diameter thereof is desired to be approximately in the range of from 1/100 to 1/10 of the average particle diameter of toner particles. If the average particle diameter of these minute particles is less than 1/100 of the average particle diameter of toner particles, the minute particles fixed and/or attached on the surface of the toner core particles fail to form irregularities of a sufficient height on the surface and, therefore, cannot be expected to improve the cleanability of the toner. Conversely, if the average particle diameter of the minute particles exceeds 1/10 of the average particle diameter of the toner particles, the minute particles attached and/or fixed on the surface of toner particles have a high possibility of seriously impairing the flowability of spherical toner particles. Further, in the use of such minute particles of a relatively large average particle diameter as described above, the number of such minute particles fixed on each toner particle is so small that a slight change in the number of fixed minute particles possibly disperses conspicuously the weight of attached and/or fixed organic or inorganic minute particles among the toner particles and consequently widens the ranges of distribution of surface properties of the toner.

In the electrostatic latent image-developing toner of the fifth embodiment of the present invention, such organic or inorganic minute particles as added externally to the core particles for the purpose of improving the cleanability are distributed locally on the surface of the core particles.

Owing to this local distribution of the minute particles, the minute particles added in a small amount as described above allow effective formation of irregularities on the surface, ensure infallible inhibition of the rotation of toner particles during the contact thereof with the cleaning blade, nullify the possibility that the pressed contact of the cleaning blade will concentrate stress on the added minute particles, and preclude the possibility that the minute particles on thermal fusion will adhere fast to the surface of the photosensitive material and inflict injuries to the photosensitive material.

Since the minute particles fixed and/or attached on the surface of core particles for the purpose of improving the cleanability of the toner are extremely small and yet are distributed locally as described above, they are enabled to manifest the expected function stably for a long time without entailing the possibility that the stress exerted during the stirring will be concentrated on the individual minute particles, the possibility that the protracted stirring will compel these minute particles to be embedded into the toner particles, or the possibility that the amount of minute particles allowed to function effectively will decrease because of the embedment of the minute particles in the toner particles as observed when these minute particles are distributed in a dispersed manner.

This state of local distribution of minute particles described above is desired particularly to satisfy the condition that the area in which the fixation density (D) of the fluidifying agent on the surface of core particles is not more than 50% of the average value of D accounts for a proportion of not more than 20% of the entire surface of core particles, preferably that the area in which the fixation density is not more than 30% of the average value of D accounts for a proportion of not less than 30% of the entire surface of core particles.

The amount of the organic or inorganic minute particles to be added is desired to be in the range of from 0.5 to 10 parts by weight, preferably from 1 to 5 parts by weight, based on 100 parts by weight of core particles. If the amount of the minute particles to be added exceeds 10 parts by weight, based on 100 parts by weight of core particles, the possibility that the shape of spherical toner particles and the characteristics attendant thereon will be impaired is great. Conversely, if this amount of addition of the minute particles is less than 0.5 part by weight, the possibility that irregularities enough to impede the rolling of the toner particles and contribute to improving the cleanability of the toner will not be formed even when the minute particles are distributed locally on the surface of core particles is high.

The method to be employed for the attachment and/or fixation of cleanability-improving minute particles on the surface of core particles in the present embodiment may be the same as that described above with respect to the first embodiment.

Figure 4:
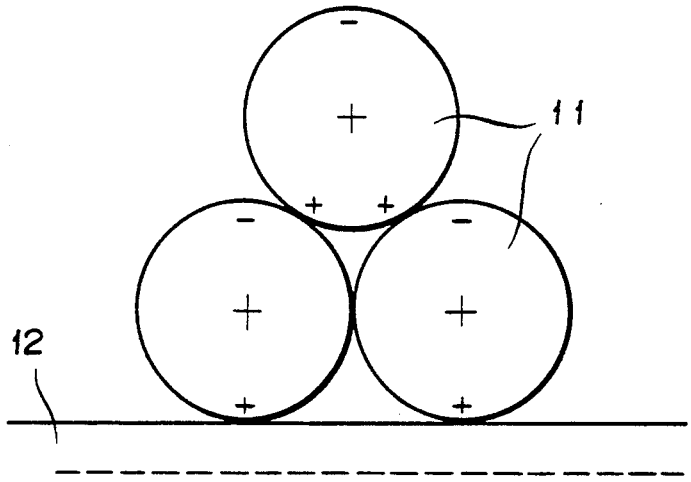
FIG. 4 is a type diagram illustrating the state of attachment of a toner incorporating therein a highly dielectric substance to the surface of a photosensitive material.

The electrostatic latent image-developing toner of the fifth embodiment of the present invention has organic or inorganic minute particles locally distributed on the surface of core particles for the purpose of improving the cleanability as described above. Further for the purpose of improving the flowability of the toner, it is permissible to have a fluidifying agent externally added to the surface of the toner particles and attached or fixed on the surface of the core particles in the same manner as when the conventional toner is subjected to an aftertreatment. This fluidifying agent is desired to be uniformly added to the surface of core particles. The fluidifying agent has no particular restriction except for the sole requirement that it should avoid exhibiting magnetism. The particle diameter of the fluidifying agent ought to be smaller than that of the minute particles which are to be added for the purpose of improving the cleanability of the toner. To be specific, this particle diameter is approximately in the range of from 0.001 to 0.1 μm, preferably from 0.005 to 0.08 μm. The amount of this fluidifying agent to be added is approximately in the range of from 0.01 to 3.0 parts by weight, preferably from 0.05 to 1.0 part by weight, based on 100 parts by weight of the toner particles. Sixth embodiment: addition of highly dielectric substance In the electrophotographic process, the development of an electrostatic latent image formed on a photosensitive material is accomplished by the phenomenon that a toner furnished with an electric charge opposite in polarity to the latent image is deposited on the latent image by dint of Coulomb attraction. In the electrostatic latent image-developing toner of the sixth embodiment of the present invention, since the toner incorporates therein a highly dielectric substance, toner particles 11 which are attached to the surface of a latent image of a photosensitive material 12 induce dielectric polarization and, as a consequence, the surfaces of the toner particles 11 attached to the surface of the latent image opposite to the surface of the latent image assume a potential close to the potential of the surface of the latent image as illustrated in FIG. 4. Thus, other toner particles 11 are attached to the former toner particles 11 and, as this phenomenon repeats itself, a plurality of layers of toner particles are deposited on the photosensitive material to augment the density of the image.

Figure 5A:
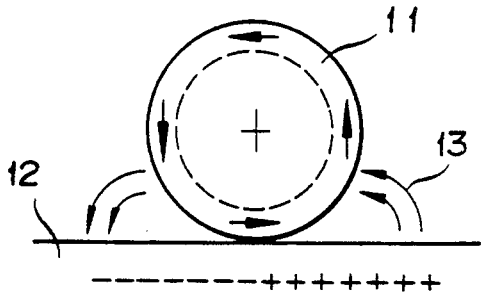
FIG. 5*a* is a type diagram illustrating the state of polarization of a toner incorporating a highly dielectric substance in the surface region thereof in the line edge part of a latent image.
Figure 5B:
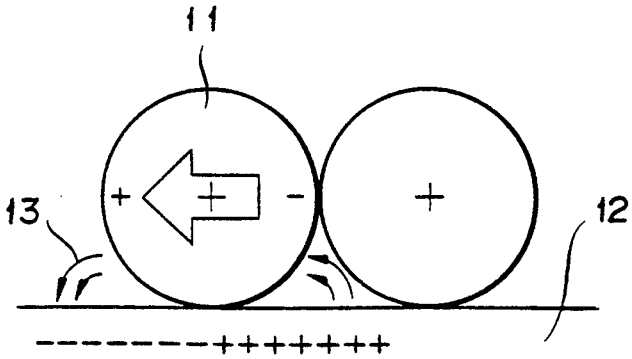
FIG. 5*b* is a type diagram illustrating the state of polarization of a toner incorporating a highly dielectric substance in the interior thereof in the line edge part of a latent image.

In the toner which has the dielectric substance added to the interior of toner particles, a toner particle 11 attached to a line edge part of an electrostatic latent image formed on a photosensitive material 12 as illustrated in FIG. 5*b* is caused to induce dielectric polarization parallel to the surface of the photosensitive material 12 by dint of an electric field 13 drawn in circuitously from the edge part. As a result, a toner particle is attached also to the non-image part of the photo-sensitive material 12, to open up the possibility that the line edge part will become unstable. In the electrostatic latent image-developing toner of the sixth embodiment of the present invention, since the addition of a highly dielectric substance is effected by having this substance fixed on the surface of toner particles, the highly dielectric substance is present only in the surface region of the toner particles. In the electrostatic latent image-developing toner of the sixth embodiment, therefore, the dielectric polarization occurs only in the surface region of toner particles. Since the dielectric polarization which occurs in a toner particle 11 which is attached to the line edge part is directed in the lateral surface part of the toner particle 11 substantially perpendicularly to the surface of the photosensitive material 12 as illustrated in FIG. 5*a*, the possibility that another toner particle will adhere to the non-image part side lateral surface of the former toner particle is small. Thus, the image acquires a sharp line edge.

Further, the highly dielectric substance having a dielectric constant exceeding 100 which is used in the sixth embodiment of the present invention generally has high hardness. When the highly dielectric substance fixed on the surface of toner particles is so large as to protrude prominently from the surface of toner particles, the possibility that the protruding dielectric substance will inflict injuries as on the cleaning part is undeniable. Particularly in the electrophotographic process using an organic photosensitive material, this possibility poses a serious problem because the sensitive material has low surface strength. The highly dielectric substance fixed on the surface of toner particles, therefore, must be used in the form of minute particles. In order for the highly dielectric substance in the form of such minute particles as described above to bring about dielectric polarization enough to realize such attachment of a plurality of layers of toner particles as described above, it is necessary that the minute particles of the highly dielectric substance should be fixed in a high density. When the substance of such high hardness is copious in the surface region of toner particles, however, the resin contained as a binding agent inside the toner particles is not thoroughly dissolved during the fixation and the problem of sacrificing the strength of fixation ensues. In the electrostatic latent image-developing toner of the sixth embodiment of the present invention, therefore, the highly dielectric substance in the form of minute particles is distributed locally in a high density on the surface of toner particles so as to attain amply the improvement of the developing property by the use of this substance in a small amount and, at the same time, to preclude the occurrence of such inconveniences as injuries on the photosensitive material and damages to the work of fixation due to the incorporation of the highly dielectric substance.

The core particles to be used for the electrostatic latent image-developing toner of the sixth embodiment of the present invention may be of the same construction as described above with respect to the first embodiment.

The highly dielectric substance to be fixed on the surface of core particles is only required to have a dielectric constant of not less than 100. The highly dielectric substances which are effectively usable herein include barium titanate, lead titanate, strontium titanate, lithium titanate, potassium titanate, bismuth titanate, calcium titanate, rutile type titanium dioxide, lithium niobate, potassium niobate, sodium niobate, lithium tantalate, lead zirconate, beryllium zirconate, barium stannate, and substitution type solid solutions of these compounds produced by the use of such additives as a shifter or a depressor, for example. The highly dielectric substance is not limited to the substances cited above but is only required to satisfy the condition mentioned above. These highly dielectric substances having a dielectric constant of not less than 100 may be used singly or jointly in the form of a combination of two or more members. Further, the highly dielectric substance to be used herein is desired to have undergone a treatment for impartation of hydrophobicity so as to stabilize the electric charging property of toner particles enough to resist moisture. The highly dielectric substance to be used in the sixth embodiment of the present invention is required to possess a dielectric constant of not less than 100. If the dielectric constant is less than 100, the possibility that the electric field near the photosensitive material will prevent the dielectric substance from producing effective dielectric polarization is high even when the dielectric substance is added in a relatively large amount to the surface of toner particles. This highly dielectric substance is fixed in the form of minute particles on the surface of core particles. Specifically as respects the size of the minute particles of the highly dielectric substance, the average particle diameter thereof is desired to be approximately in the range of from 0.001 to 1 μm, preferably from 0.01 to 0.1 μm. If the average particle diameter of the minute particles of the highly dielectric substance is less than 0.001 μm, the minute particles as primary particles are not easily dispersed and, therefore, have the possibility of producing adverse effects on the stability of toner production or the stability of durability. Conversely, if the average particle diameter exceeds 1 μm, the minute particles of the dielectric substance fixed on the surface of core particles protrude prominently from the surface of toner particles. When the toner containing such protruding minute particles is used, the possibility that this toner will inflict injuries on the surface of the photosensitive material is great.

The amount of the minute particles of the highly dielectric substance to be added, though variable with the kind of the minute particles, is desired to be in the range of from 0.1 to 3 parts by weight, preferably 0.3 to 1 parts by weight, based on 100 parts by weight of core particles. If the amount of the minute particles to be added exceeds 3 parts by weight, based on 100 parts by weight, the possibility that this insoluble substance existing on the surface of toner particles will prevent the resin component present inside the toner particles from being melted during the fixation and consequently will seriously impair the strength of fixation is present. Conversely, if this amount of addition is less than 0.1 part by weight, the possibility that the toner particles attached to the photosensitive material will not induce sufficient dielectric polarization during the development and the attachment of a plurality of layers of toner particles on the surface of a latent image and the consequent increase of image density will be attained only with difficulty is great.

In the electrostatic latent image-developing toner of the sixth embodiment of the present invention, the minute particles of the highly dielectric substance described above are fixed in a high density locally on the surface of core particles. For the purpose of improving the efficiency of development owing to the operation described above by fixing the minute particles of the highly dielectric substance of an average particle diameter of not more than 1 μm on the surface of core particles, the amount of the minute particles required to be added is not less than 5 parts by weight, preferably not less than 10 parts by weight, when the minute particles are fixed uniformly on the surface of core particles. The addition of the minute particles of the highly dielectric substance in such a large amount as mentioned above is undesirable because it degrades the strength of fixation as described above. In the sixth embodiment of the present invention, the minute particles of the highly dielectric substance are distributed in a high density locally on the surface of core particles so that the use of the minute particles in a small amount of not more than 3 parts by weight will suffice to bring about the effect of sufficiently improving the efficiency of development.

This state of local distribution of the minute particles of the highly dielectric substance is desired particularly to satisfy the condition that the area in which the fixation density (D) of the minute particles of highly dielectric substance on the surface of core particles is not less than 1.5 times the average value of D should account for a proportion of not less than 20% of the entire surface of core particles, preferably that the area in which the fixation density is not less than 2.0 times the average value of D should account for a proportion of not less than 30% of the entire surface of core particles.

The method to be employed for the attachment and/or fixation of the minute particles of the highly dielectric substance on the surface of core particles may be the same as described above with respect to the first embodiment.

Optionally, in the electrostatic latent image-developing toner of the sixth embodiment of the present invention, such other additives as a fluidifying agent may be externally added in the form of minute particles and attached or fixed on the surface of core particles in addition to the minute particles of the highly dielectric substance mentioned above.

EXAMPLES

Now, the present invention will be described more specifically below with reference to working examples. The following working examples are meant to be purely illustrative and not limitative in any respect of the present invention.

Referential Example 1

Production of negatively charged inorganic minute particles

A mixed solution was prepared by dissolving 1.5 g of 3,3,4,4,5,5,6,6,7,7,8,8,10,10,10-heptadecafluorodecyltrimethoxy silane as a fluorine-containing coupling agent and 1.0 g of hexamethyl disilane in 10 g of tetrahydrofuran. In a drier, colloidal silica as an inorganic powder (produced by Japan Aerosil Co., Ltd. and marketed under trademark designation of "AEROSIL 300") was treated at 20° C. for two hours. In a high-speed mixer, 25 g of the dried colloidal silica was kept stirred and the aforementioned mixed solution was gradually added thereto meanwhile over a period of about five minutes. The resultant mixture was further stirred vigorously for 10 minutes, heated in a constant temperature bath at 150° C., and disintegrated to obtain negatively charged inorganic minute particles having a hydrophobicity degree of 63% and a primary particle diameter of 17 m μ.

Referential Example 2

Production of positively charged resin minute particles x

A solution of 0.5 g of ammonium persulfate in 800 g of deionized water was placed in a four-neck flask and, with the entrapped air therein displaced with nitrogen, heated to 75° C. In the heated solution, 150 g of methyl methacrylate, 30 g of butyl acrylate, and 20 g of N,N-dimethylaminoethyl methacrylate were stirred to be polymerized for six hours to obtain positively charged resin minute particles having an average particle diameter of 0.3 μm.

Referential Example 3

Production of negatively charged resin minute particles y

Negatively charged resin minute particles y having an average particle diameter of 0.1 μm were obtained by following the procedure of Referential Example 1, except a monomer composition consisting of 120 g of styrene, 2 g of methacrylic acid, 38 g of butyl acrylate, and 40 g of 2,2,2-trifluoroethyl acrylate was used instead.

Example 1

Production of toner 1

In a ball mill, 100 parts by weight of styrene-n-butyl methacrylate copolymer (having a softening point of 132° C. and a glass transition point of 60° C.), 8 parts by weight of carbon black (produced by Mitsubishi Chemical Industries, Ltd. and marketed under product code of "MA #8"), and 5 parts by weight of low molecular polypropylene (produced by Sanyo Chemical Industries, Ltd. and marketed under trademark designation of "Viscor 550P") were thoroughly mixed and then kneaded on a three-piece roll heated at 140° C. The resultant blend was left cooling, then ground coarsely by the use of a feather mill, and further pulverized finely with the feather mill, to obtain toner core particles a having an average particle diameter of 10 μm. A nigrosine type charge-controlling agent (produced by Orient Kagaku Kogyo K.K. and marketed under trademark designation of "Nigrosine Base EX") was wet pulverized in an aqueous medium to an average particle diameter of 0.3 μm by the use of a sand mill. In a wet surface-modifying device (produced by Nisshin Engineering K.K. and marketed under trademark designation of "Dispercoat"), the toner core particles a obtained as described above were treated by the liquid immersion method using the pulverized nigrosine type charge-controlling agent so that 0.5 part by weight of the charge-controlling agent would be fixed locally on the surface of 100 parts by weight of the core particles. Consequently, a toner 1 having a surface average particle diameter of 8 μm was obtained.

When the surface of the toner 1 was observed under a scanning electron microscope, the charge-controlling agent was found to be fixed locally on the toner surface.

Example 2

Production of toner 2

In a ball mill, 100 parts by weight of polyester resin (produced by Kao Soap Co., Ltd. and marketed under trademark designation of "Tafton NE-1110"), 8 parts by weight of carbon black (produced by Mitsubishi Chemical Industries, Ltd. and marketed under product code of "MA #8"), and 3 parts by weight of low molecular weight oxide type polypropylene (produced by Sanyo Chemical Industries, Ltd. and marketed under trademark designation of "Viscor TS-200") were thoroughly mixed and then kneaded on a three-piece roll heated at 140° C. The resultant blend was left cooling and then coarsely ground by the use of a feather mill to obtain a coarse toner having a maximum particle diameter of 3 mm. Then, 100 parts by weight of the coarse toner was mixed with 1.0 part by weight of a chromium complex type charge-controlling agent (produced by Hodogaya Chemical Co., Ltd. and marketed under trademark designation of "Aizenspiron Black TRH") which had been wet pulverized in an aqueous medium by the use of a sand mill, filtered, and dried to be given an average particle diameter of 0.2 μm. The resultant blend was placed in a Henschel mixer and stirred therein at a rotational speed of 1,500 rpm for two minutes. Then, the resultant mixture was finely pulverized by the use of a jet mill (produced by Kawasaki Jukogyo Kabushi Kaisha and marketed under trademark designation of "Crypton System") and aerially classified, to obtain a toner 2 having a surface average particle diameter of 7 μm.

When the surface of this toner 2 was observed under a scanning electron microscope, the charge-controlling agent was found to be fixed locally on the toner surface.

Example 3

Production of toner 3

In a sand stirrer, 100 parts by weight of styrene, 35 parts by weight of n-butyl methacrylate, 5 parts by weight of methacrylic acid, 0.5 part by weight of 2,2-azobis-(2,4-dimethyl valeronitrile), 8 parts by weight of carbon black (produced by Mitsubishi Chemical Industries, Ltd. and marketed under product code of "MA #8"), and 3 parts by weight of low molecular polypropylene (produced by Sanyo Chemical Industries, Ltd. and marketed under trademark designation of "Viuscor 605P") were mixed to prepare a polymer composition. By the use of a stirrer (produced by Tokushu Kikakogyo K.K. and marketed under trademark designation of "TK Autohomomixer"), the polymer composition was left polymerizing at 60° C. for six hours as kept stirred at a rate of 4,000 rpm meanwhile. After completion of the polymerization, the resultant reaction mixture was washed with deionized water, dried, and aerially classified, to obtain toner core particles c having a surface average particle of 6 μm. Then, in a wet surface-modifying device (produced by Nisshin Engineering K.K. and marketed under trademark designation of "Dispercoat"), the toner particles c were treated by the solution immersion method using a chromium complex type charge-controlling agent (produced by Hodogaya Chemical Co., Ltd. and marketed under trademark designation of "Aizenspiron Black TRH") which had been wet pulverized in an aqueous medium by the use of a sand mill and given an average particle diameter of 0.2 μm so that 0.8 part by weight of the charge-controlling agent would be fixed locally on the surface of 100 parts by weight of the toner core particles. Consequently, a toner c having a surface average particle diameter of 6 μm was obtained.

When the surface of this toner 3 was observed under a scanning electron microscope, the charge-controlling agent was found to be fixed locally on the toner surface.

Example 4

Production of toner 4

The negatively charged inorganic minute particles (charge-controlling silica minute particles) obtained in Referential Example 1 were dispersed in ethanol. In a wet surface-modifying device (produced by Nisshin Engineering K.K. and marketed under trademark designation of "Dispercoat"), the toner core particles a obtained in Example 1 were treated by the solution immersion method using the dispersion obtained above so that 0.8 part by weight of the silica minute particles would be fixed locally on the surface of 100 parts by weight of the toner core particles a. Consequently, a toner 4 having a surface average particle diameter of 8 μm was obtained.

When the surface of this toner 4 was observed under a scanning electron microscope, the charge-controlling silica minute particles were found to be fixed locally on the toner surface.

Example 5

Production of toner 5

In a wet surface-modifying device (produced by Nisshin Engineering K.K. and marketed under trademark designation of "Dispercoat"), the toner core particles a obtained in Example 1 were treated by the solution dispersion method using a slurry of the positively charged resin minute particles x obtained in Referential Example 2 so that 0.5 part by weight of the minute particles x would be fixed locally on the surface of 100 parts by weight of the toner core particles a. Consequently, a toner 5 having a surface average particle diameter of 8 μm was obtained.

When the surface of this toner 5 was observed under a scanning electron microscope, the positively charged resin minute particles x were found to be fixed locally on the toner surface.

Example 6

Production of toner 6

In a wet surface-modifying device (produced by Nisshin Engineering K.K. and marketed under trademark designation of "Dispercoat"), the toner core particles a obtained in Example 1 were treated by the solution dispersion method using a slurry of the negatively charged resin minute particles y obtained in Referential Example 3 so that 0.5 part by weight of the minute particles y would be fixed locally on the surface of 100 parts by weight of the toner core particles a. Consequently, a toner 6 having a surface average particle diameter of 8 μm was obtained.

When the surface of this toner 6 was observed under a scanning electron microscope, the negatively charged resin minute particles y were found to be fixed locally on the toner surface.

Control 1

Production of toner 7

A toner 7 having a surface average particle diameter of 8 μm was obtained by faithfully following the procedure of Example 1, except the surface treatment of the toner core particles a with the charge-controlling agent by the use of the surface-modifying device was carried out by the slurry method in the place of the solution immersion method after the toner core particles and the charge-controlling agent were thoroughly mixed in a dispersion medium (aqueous 10 wt % ethanol solution).

When the surface of this toner 7 was observed under a scanning electron microscope, the charge-controlling agent was found to be fixed uniformly on the toner surface.

Control 2

Production of toner 8

A toner 8 having a surface average particle diameter of 7 μm was obtained by following the procedure of Example 2, except the addition and mixture of the charge-controlling agent was carried out after the fine pulverization and aerial classification instead of after the coarse grinding and the fixation of the charge-controlling agent was effected by application of heat.

When the surface of this toner 8 was observed under a scanning electron microscope, the charge-controlling agent was found to be fixed uniformly on the toner surface.

Control 3

Production of toner 9

A toner 9 having a surface average particle diameter of 6 μm was obtained by following the procedure of Example 3, except the surface treatment of the toner core particles c with the charge-controlling agent by the use of the surface-modifying device was carried out by the slurry method in the place of the solution immersion method after the toner core particles and the charge-controlling agent were thoroughly mixed in a dispersion medium (aqueous 10 wt % ethanol solution).

When the surface of this toner 9 was observed under a scanning electron microscope, the charge-controlling agent was found to be fixed uniformly on the toner surface.

Control 4

Production of toner 10

A toner 10 having a surface average particle diameter of 8 μm was obtained by following the procedure of Example 5, except the surface treatment of the toner core particles a with the positively charged resin minute particles x by the use of the surface-modifying device was carried out by the slurry method in the place of the solution immersion method after the toner core particles and the positively charged resin minute particles x were thoroughly mixed in a dispersion medium (aqueous 10 wt % ethanol solution).

When the surface of this toner particle 10 was observed under a scanning electron microscope, the positively charged resin minute particles x were found to be fixed uniformly on the surface of the toner particle.

Control 5

Production of toner 11

A toner 11 having a surface average particle diameter of 6 μm was obtained by following the procedure of Example 3, except the charge-controlling agent ("Aizenspiron Black TRH") having an average particle diameter of 1.0 μm was used in its unpulverized form.

When the surface of this toner particle 11 was observed under a scanning electron microscope, the charge-controlling agent was found to be fixed at a rate of approximately 2 to 7 minute particles per core particle of the toner 1.

Referential Example 4

Production of carrier

A binder type carrier was prepared as shown below for the purpose of enabling the toners obtained in the working examples and controls described above to be subjected to the evaluation described hereinafter.

In a Henschel mixer, 100 parts by weight of polyester resin (produced by Kao Soap Co., Ltd. and marketed under product code of "NE-1110"), 500 parts by weight of inorganic magnetic powder (produced by Toda Industries, Ltd. and marketed under product code of "EPT-1000"), and 2 parts nb Industries, Ltd. and marketed under product code of "MA #8") were thoroughly mixed and pulverized and then melted and kneaded by the use of an extrusion kneader having a cylinder part kept at 180° C. and a cylinder part kept at 170° C. The resultant blend was left cooling, then ground coarsely by the use of a feather mill, further pulverized finely with a jet mill, and classified with a classifier to obtain a carrier having an average particle diameter of 55 μm.

Method for evaluation of properties:

The toners 1 to 11 obtained in Examples 1 to 6 and Controls 1 to 5 as described above were tested for various properties as follows.

Determination of particle diameter:

(1) Particle diameter of toner

The toner particle diameters mentioned hereinabove represent the surface average particle diameters determined by a measurement using a laser scattering type grain size distribution tester (produced by Shimadzu Seisakusho Ltd. and marketed under product code of "SALT-1100").

(2) Particle diameter of carrier:

The carrier particle diameters mentioned hereinabove represent the average particle diameters determined by a measurement using an instrument (produced by Nikkiso Ltd. and marketed under trademark designation of "Microtrack Model 7995-10SRA").

State of attachment/fixation of minute particles (charge-controlling minute particles):

The surface image of a toner particle on which minute particles of a charge-controlling agent had been fixed was injected into an image analyzing device with the aid of a scanning electron microscope and the state of distribution of minute particles fixed on the surface of the toner particle was examined as follows.

(1) On the displayed surface image of the toner particle, the ratio of surface areas occupied by the minute particles of charge-controlling agent was determined.

(2) The operation of (1) was performed on 50 toner particles and the numerical values found in the 50 runs were averaged. The result was reported as an average fixation density.

(3) The displayed surface image of the toner particle was divided into areas each of the square of 1/20 of the average particle diameter of the toner particle and the ratio of surface area occupied by minute particles was determined in each of the divided areas.

(4) From the divided areas, those in which the ratio of surface area determined in (3) was not less than 1.5 times the average fixation density were selected and the ratio of the selected areas to the entire surface area was calculated.

(5) The operation of (4) was performed on 50 toner particles and the numerical values found in the 50 runs were averaged. The result was reported as a ratio of surface area allowing local presence of minute particles.

By this method, the toner particles obtained in the working examples and the controls were tested for ratio of surface area allowing local presence of minute particles. The results of the test are shown in Table 1.

Figure 6:
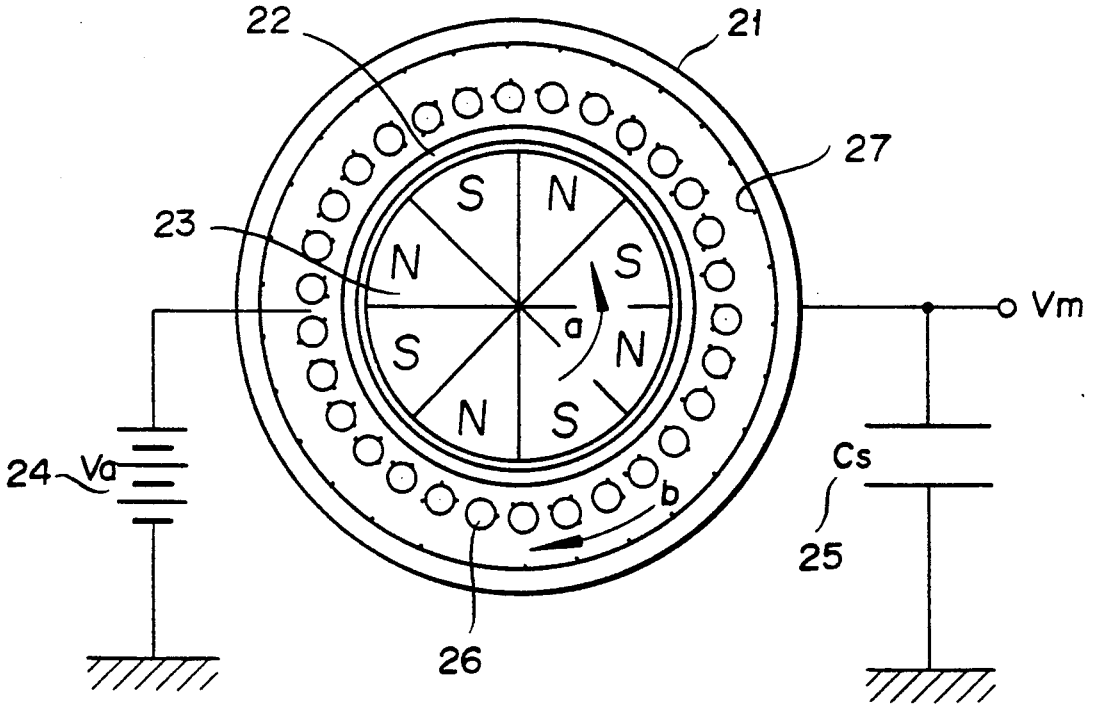
FIG. 6 is a diagram schematically illustrating the construction of a charge distribution testing device to be used for the determination of charge distribution.

Determination of distribution of charge:

The distribution of charge was determined by the use of an instrument published by Terasaka et al from Minolta Camera Co., Ltd. at the 58th study forum sponsored by the Electrophotographic Study Society and held on Nov. 28, 1986. The operating principle of this instrument is described in detail in materials distributed in the forum. So, the principle will be simply briefed here. FIG. 6 schematically illustrates the construction of this instrument. The method of determination by the use of this instrument will be described below.

Figure 7:
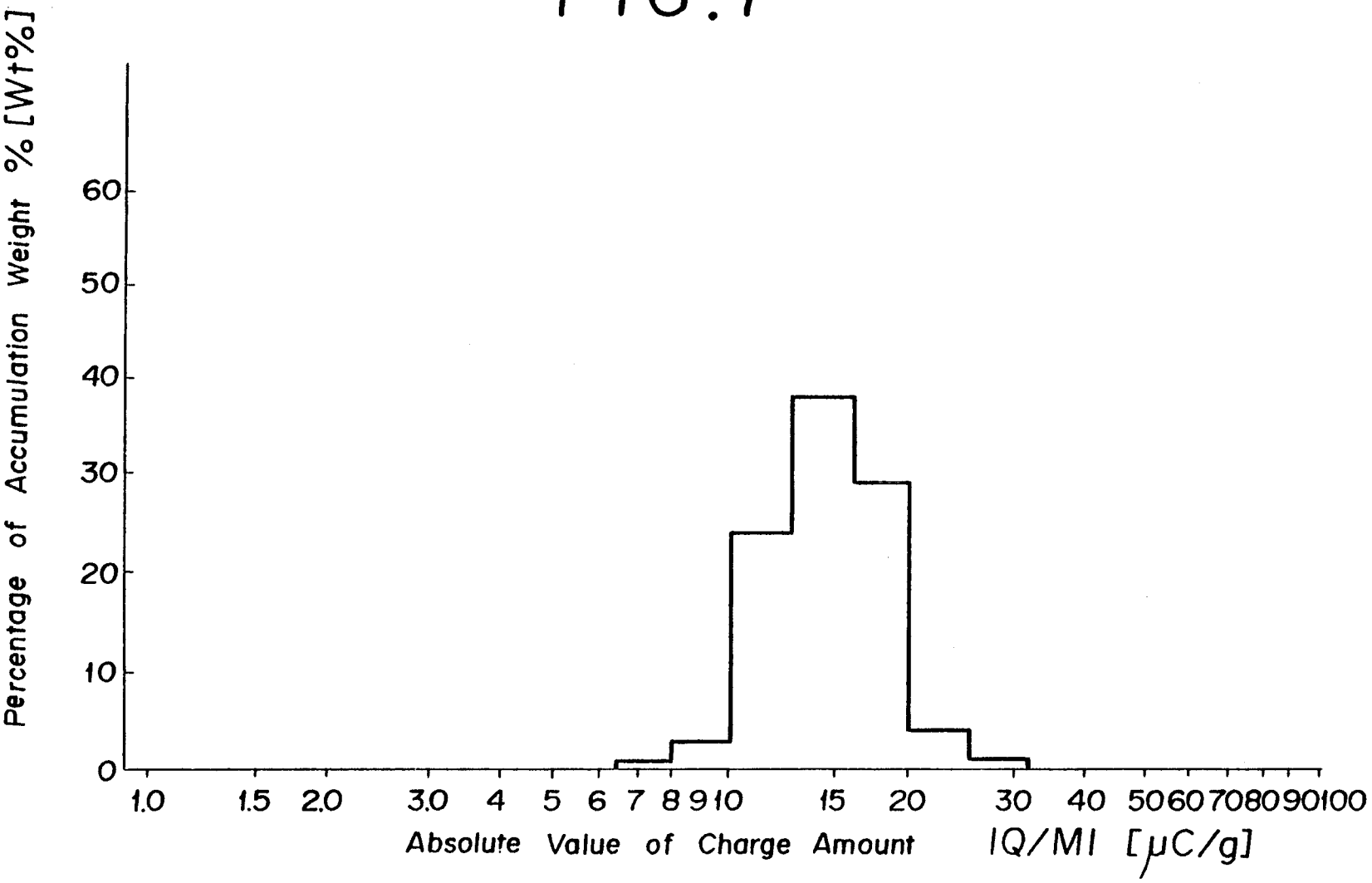
FIG. 7 is a diagram showing the results of determination of charge distribution performed on an example of the electrostatic latent image-developing toner of the present invention.

The revolution number of a magnetic roll 23 was set at 100 rpm and a developing agent 26 which was stirred as described specifically hereinbelow was used. Three (3) grams of this developing liquid 26 was weighed out with a precision balance and placed uniformly on the entire surface of an electroconductive sleeve 22. Then a bias voltage from a bias power source 24 was applied as gradually increased from 0 to 10 kV and the sleeve 22 was rotated for five seconds. The potential, Vm, of the sleeve 22 at the end of the rotation was read out. The weight, Mi, of separate toner 27 adhering to a cylindrical electrode 21 at the moment was found with the precision balance, to find the average charge on the toner. The found values of the mass of toner in % by weight and the amount of charge in Q/M were plotted respectively against the vertical axis and the horizontal logarithmic axis, to obtain a graph. FIG. 7 represents one example of the graph, showing the results of the test performed on the toner 1 obtained in Example 1. In this graph, the range of $10^0$ to $10^2$ of the horizontal axis (Q/M) was equally divided into 20 portions each as a channel, the three channels showing the first to third largest values of weight % were picked out, and the cumulative total of the values of weight % in these three channels was found.

(1) Distribution of initial charge

One hundred (100) parts by weight of a sample toner from the working examples and the controls cited above was aftertreated with 0.1 part by weight of colloidal silica (produced by Japan Aerosil Ltd. and marketed under product code of "R-574"). A developing agent was prepared by placing 2 g of the aftertreated toner and 28 g of the aforementioned carrier in a polyethylene vial having an inner volume of 50 cc, mounting the vial on a rotary stand, and rotating the vial at 1,200 rpm for 30 minutes. The developing agent thus obtained was evaluated by the aforementioned method for determination of distribution of charge. The sharpness of the distribution of charge was rated by Mp.

| Rank of distribution of charge | Mp (wt %) |
|---|---|
| 1 | <50 |
| 2 | 50–65 |
| 3 | 65–80 |
| 4 | 80–95 |
| 5 | >95 |

The results are shown in Table 1.

(2) Distribution of charge after protracted stirring

A developing agent was prepared by mixing a sample toner aftertreated in the same manner as for the determination of distribution of initial charge and a carrier at a weight ratio of 7/93. The developing agent thus obtained was placed in the developing device for a copier (produced by Minolta Camera Co., Ltd. and marketed under product code of "EP-8600") and the developing device was operated at the same revolution number as used in the copier to stir the developing agent contained therein. After this operation was continued for 24 hours, the developing agent in the developing device was tested by the same method as used for determination of the distribution of initial charge. The values found was rated. The results are shown in Table 1.

TABLE 1

| | Toner | Ratio of area for local presence of minute particles (%) | Rank of distribution of initial charge | Rank of distribution of charge after protracted stirring |
|---|---|---|---|---|
| Example 1 | 1 | 43 | 4 | 4 |
| Example 2 | 2 | 40 | 4 | 4 |
| Example 3 | 3 | 37 | 5 | 4 |
| Example 4 | 4 | 49 | 4 | 4 |
| Example 5 | 5 | 44 | 4 | 4 |
| Example 6 | 6 | 43 | 4 | 4 |
| Control 1 | 7 | 4 | 4 | 2 |
| Control 2 | 8 | 4 | 4 | 2 |
| Control 3 | 9 | 3 | 5 | 2 |
| Control 4 | 10 | 6 | 4 | 1 |
| Control 5 | 11 | 27 | 3 | 2 |

Example 7

Production of toner 12

In a ball mill, 100 parts by weight of polyester resin (produced by Kao Soap Co., Ltd. and marketed under trademark designation of "Tafton NE-382"), 3 parts by weight of Brilliant Carmine 6B (C.I. 15850), and 5 parts by weight of zinc complex (produced by Orient Chemical Industries, Ltd. and marketed under product code of "E-84") were thoroughly mixed and then kneaded on a three-piece roll heated at 140° C. The resultant blend was left cooling, then coarsely ground by the use of a feather mill, and further pulverized finely with a jet mill. The resultant powder was aerially classified to obtain core particles d having an average particle diameter of 8 μm. Hydrophobic silica having an average particle diameter of 12 mμ (produced by Japan Aerosil Ltd. and marketed under trademark designation of "R-974") was thoroughly dispersed in ethanol. In a wet surface-modifying device (Nisshin Engineering Co., Ltd. and marketed under trademark designation of "Dispercoat"), the core particles were treated by the solution immersion method using the dispersion obtained above so that 0.5 part by weight of the hydrophobic silica particles were fixed locally on the surface of 100 parts by weight of the core particles d. A toner 12 having an average particle diameter of 8 μm was obtained by mixing 100 parts by weight of the resultant particles with 0.2 part by weight of hydrophobic silica having an average particle diameter of 12 mμ (produced by Japan Aerosil Ltd. and marketed under product code of "R-974") and 0.5 part by weight of hydrophobic titanium dioxide having an average particle diameter of 30 mμ (produced by Deggusa and marketed under product code of "T-805"), placing the resultant mixture in a Henschel mixer, stirring it at a revolution number of 150 rpm for one minute, and aftertreating the blend as practiced for a toner.

Control 6

Production of toner 13

A toner 13 having an average particle diameter 8 μm was obtained by mixing 100 parts by weight of the core particles d prepared in Example 7 with 0.2 part by weight of hydrophobic silica having an average particle diameter of 12 mμ (produced by Japan Aerosil Ltd. and marketed under product code of "R-974") and 0.5 part by weight of hydrophobic titanium dioxide having an average particle diameter of 30 mμ (produced by Deggusa and marketed under product code of "T-805"), placing the resultant mixture in a Henschel mixer, stirring it at a revolution number of 1,500 rpm for one minute, and aftertreating the blend as practiced for a toner.

Control 7

Production of toner 14

A toner having an average particle diameter of 8 μm was obtained by mixing 100 parts by weight of the core particles d prepared in Example 7 with 0.7 part by weight of hydrophobic silica having an average particle diameter of 12 mμ (produced by Japan Aerosil Ltd. and marketed under product code of "R-974") and 0.5 part by weight of hydrophobic titanium dioxide having an average particle diameter of 30 mμ (produced by Deggusa and marketed under product code of "T-805"), placing the resultant mixture in a Henschel mixer, stirring it at a revolution number of 1,500 rpm for one minute, and aftertreating the blend as practiced for a toner.

Example 8

Production of toner 15

Core particles e having an average particle diameter of 6 μm were obtained by following the procedure of Example 3, except 3 parts by weight of a chromium complex type dye (produced by Hodogaya Chemical Co., Ltd. and marketed under trademark designation of "Aizenspiron Black TRH") was added as a material for forming toner core particles. Hydrophobic silica having an average particle diameter of 7 mμ (produced by Japan Aerosil Ltd. and marketed under product code of "R-976") was thoroughly dispersed in ethanol. In a wet surface-modifying device (produced by Nisshin Engineering Co., Ltd. and marketed under trademark designation of "Dispercoat"), the core particles e were treated by the solution immersion method using the dispersion obtained above so that 0.5 part by weight of the hydrophobic silica particles would be fixed locally on the surface of 100 parts by weight of the core particles e. A toner 15 having an average particle diameter of 6 μm was obtained by mixing 100 parts by weight of the particles consequently obtained with 0.3 part by weight of hydrophobic silica having an average particle diameter of 7 mμ (produced by Japan Aerosil Ltd. and marketed under product code of "R-976"), placing the resultant mixture in a Henschel mixer, stirring it at a revolution number of 1,500 rpm for one minute, and aftertreating the blend as practiced for a toner.

Control 8

Production of toner 16

A toner 16 having an average particle diameter of 6 μm was obtained by mixing 100 parts by weight of the core particles e prepared in Example 8 with 0.3 part by weight of hydrophobic silica having an average particle diameter of 7 mμ (produced by Japan Aerosil Ltd. and marketed under product code of "R-976"), placing the resultant mixture in a Henschel mixer, stirring it at a revolution number of 150 rpm for one minute, and aftertreating the blend as practiced for a toner.

Control 9

Production of toner 17

A toner 17 having an average particle diameter of 6 μm was obtained by mixing 100 parts by weight of the core particles e prepared in Example 18 with 0.8 part by weight of hydrophobic silica having an average particle diameter of 7 mμ (produced by Japan Aerosil Ltd. and marketed under product code of "R-976"), placing the resultant mixture in a Henschel mixer, stirring it at a revolution number of 1,500 rpm for one minute, and aftertreating the blend as practiced for a toner.

Control 10

Production of toner 18

A slurry containing the core particles e having an average particle diameter of 6 μm and prepared in Example 8 was obtained by washing the core particles e with deionized water and suspending the washed core particles e in water. The resultant slurry was uniformly mixed with hydrophobic silica having an average particle diameter of 7 mμ (produced by Japan Aerosil Ltd. and marketed under product code of "R-976") thoroughly dispersed in advance in ethanol to produce a homogeneous mixture. Then, in a wet surface-modifying device (produced by Nisshin Engineering Co., Ltd. and marketed under trademark designation of "Dispercoat"), the core particles e were treated by the solution immersion method using the homogeneous mixture so that 0.5 part by weight of the hydrophobic silica particles would be fixed uniformly on the surface of 100 parts by weight of the core particles e. A toner 18 having an average particle diameter of 6 μm was obtained by mixing 100 parts by weight of the particles obtained consequently with 0.3 part by weight of hydrophobic silica having an average particle diameter of 7 mμ (produced by Japan Aerosil Ltd. and marketed under product code of "R-976"), placing the resultant mixture in a Henschel mixer, stirring it at a revolution number of 1,500 rpm for one minute, and aftertreating the blend as practiced for a toner.

Example 9

Production of toner 19

In a ball mill, 100 parts by weight of thermoplastic styrene-acryl resin having Mn of 4,200, Mv of 210,000, Mz of 1,323,000, Mn/Mn of 50.2, Mz/Mn of 315, Tg of 62° C., a softening point of 115° C., and an acid number of 25.8, 8 parts by weight of carbon black (produced by Mitsubishi Chemical Industries, Ltd. and marketed under product code of "MA #8"), 4 parts by weight of low molecular polypropylene (Sanyo Chemical Industries Co., Ltd. and marketed under trademark designation of "Viscor 605P"), and 5 parts by weight of Bontron N-01 (proprietary product of Orient Chemical Industry Co., Ltd.) were thoroughly mixed and then kneaded on a three-piece roll heated at 140° C. The resultant blend was left cooling, then coarsely ground with a feather mill, and further pulverized finely with a jet mill. The resultant powder was aerially classified to obtain core particles f having an average particle diameter of 8 μm. Hydrophobic silica having an average particle diameter of 16 mμ (produced by Japan Aerosil Ltd. and marketed under product code of "R-972") was thoroughly dispersed in ethanol. In a wet surface-modifying device (produced by Nisshin Engineering Ltd. and marketed under trademark designation of "Dispercoat"), the core particles f were treated by the solution immersion method using the dispersion obtained above so that 0.5 part by weight of the hydrophobic silica particles would be fixed locally on the surface of 100 parts by weight of the core particles f. A toner 19 having an average particle diameter of 8 μm was obtained by mixing 100 parts by weight of the particles obtained consequently with 0.2 part by weight of hydrophobic silica having an average particle diameter of 16 mμ (produced by Japan Aerosil Ltd. and marketed under product code of "R-972"), placing the resultant mixture in a Henschel mixer, stirring it at a revolution number of 1,500 rpm, and aftertreating the blend as practiced for a toner.

Control 11

Production of toner 20

A toner 20 having an average particle diameter of 8 μm was obtained by mixing 100 parts by weight of the core particles f prepared in Example 9 with 0.2 part by weight of hydrophobic silica having an average particle diameter of 16 mμ (produced by Japan Aerosil Ltd. and marketed under product code of "R-972") and 0.2 part by weight of hydrophobic titanium dioxide having an average particle diameter of 30 mμ (produced by Degusa and marketed under product code of "T-805"), placing the resultant mixture in a Henschel mixer, stirring it at a revolution number of 1,500 rpm for one minute, and aftertreating the blend as practiced for a toner.

Control 12

Production of toner 21

A toner 21 having an average particle diameter of 8 μm was obtained by mixing 100 parts by weight of the core particles f prepared in Example 9 with 0.7 part by weight of hydrophobic silica having an average particle diameter of 16 mμ (produced by Japan Aerosil Ltd. and marketed under product code of "R-972"), placing the resultant mixture in a henschel mixer, stirring it at a revolution number of 1,500 rpm for one minute, and aftertreating the blend as practiced for a toner.

Method for evaluation of properties:

The toners 12 to 21 obtained in Examples 7 to 9 and Controls 6 to 12 cited above were tested for the following properties.

State of attachment/fixation of minute particles (fluidifying agent):

The toners were tested for ratio of area for local presence of minute particles by the same method as used for testing the toners 1 to 11 as described above. The results are shown in Table 2.

Environmental stability of charge (Q/M):

A developing agent was prepared by placing 2 g of a sample toner from Examples 7 to 9 and Controls 6 to 12 and 28 g of the carrier obtained in Referential Example 4 in a polyethylene vial having an inner volume of 50 cc, mounting the vial on a rotary stand, and rotating this vial at a revolution number of 1,200 rpm for 20 minutes.

This developing agent was exposed to the conditions of 5° C. in temperature and 15% in relative humidity for 24 hours and then tested for amount of charge. It was then exposed to the conditions of 35° C. in temperature and 85% in relative humidity for 24 hours and then tested for amount of charge. The difference between the two amounts thus found was used in evaluating the environmental stability of charge.

The environmental stability of charge was rated on the three-point scale, wherein ○ stands for a difference of not more than 3 μC/g, Δ for a difference of more than 3 μC/g and less than 6 μC/g, and X for a different of not less than 6 μC/g. The results of the evaluation are shown in Table 2.

Change in flowability:

A binary developing agent was prepared by mixing a sample toner from Examples 7 to 9 and Control 6 to 12 and the aforementioned carrier in a weight ratio, toner/carrier, of 7/93 for one hour. The developing agent originating in Examples 7 and 8 and Controls 6 to 10 was set in the developing device for a copier EP-570Z (proprietary product of Minolta Camera Col, Ltd) or the developing agent originating in Example 9 and Controls 11 and 12 in the developing device for a copier EP-470Z (proprietary product of Minolta Camera Co., Ltd.). The conveyor screw inside the developing devices was adjusted so that one-side deviation of the developing agent would not occur in the longitudinal direction of the developing device after 10 minutes' no-load rotation. The developing device thus adjusted was set in place in the copier and operated to produce 10,000 copies and test the copier for printability with the toner. On a wholly black image obtained on the 1,000th copy paper, two points separated by 20 cm in the direction perpendicular to the direction of paper passage were examined for image density. When the difference of image density produced in the longitudinal direction of the developing device owing to one-side deviation of the developing agent was confirmed to be not more than 0.05, the image obtained on the 10,000th copy paper was similarly examined to test the copier for printability with the toner. The printability was rated on the three-point scale, wherein ○ stands for a different of not more than 0.05, Δ for a difference of more than 0.05 and less than 0.1, and X for a difference of not less than 0.1. The results of this test are shown in Table 2.

TABLE 2

| | Toner | Ratio of surface for local presence of minute particles (%) | Environmental stability of charge (Q/M) | Change in flowability |
|---|---|---|---|---|
| Example 7 | 12 | 38 | ○ | ○ |
| Example 8 | 15 | 31 | ○ | ○ |
| Example 9 | 19 | 36 | ○ | ○ |
| Control 6 | 13 | 2 | ○ | Δ |
| Control 7 | 14 | 5 | X | Δ |
| Control 8 | 16 | 0 | ○ | X |
| Control 9 | 17 | 3 | X | Δ |
| Control 10 | 18 | 4 | X | Δ |
| Control 11 | 20 | 1 | ○ | X |
| Control 12 | 21 | 5 | X | Δ |

Example 10

Production of toner 22

The materials used for the formation of the toner core particles in Example 1 and 5 parts by weight of a nitrosine dye (produced by Orient Industries Ltd. and marketed under trademark designation of "Bontron N-01") were thoroughly mixed in a ball mill and then kneaded on a three-piece roll heated at 140° C. The resultant blend was left cooling and then coarsely ground by the use of a feather mill to obtain a coarse toner powder having a maximum particle diameter of 3 mm. A toner having an average particle diameter of 8 μm was obtained by mixing 100 parts by weight of the coarse toner powder thus obtained with 1.0 part by weight of an electroconductive carbon black having an average particle diameter of 20 mμ and a volume intrinsic resistance of 0.98 Ω·cm (produced by Columbian Carbon Corp. and marketed under trademark designation of "CONDUCTEX SC"), placing the resultant mixture in a Henschel mixer, stirring it at a revolution number of 1,500 rpm for two minutes, finely pulverizing the mixture with a jet mill (produced by Kawasaki Jukogyo Kabushiki Kaisha and marketed under trademark designation of "Crypton System"), and aerially classifying the resultant fine powder. When the surface of a toner particle thus obtained was observed under a scanning electron microscope, the electroconductive carbon black was found to be fixed locally on the toner surface. A toner having an average particle diameter of 8 μm was obtained by mixing 100 parts by weight of the particles obtained above with 0.3 part by weight of hydrophobic silica having an average particle diameter of 17 m μ (produced by Japan Aerosil Ltd. and marketed under product code of "R-974"), placing the resultant mixture in a Henschel mixer, stirring it at a revolution number of 1,500 rpm for one minute, and aftertreating the resultant blend as practiced for a toner.

Example 11

Production of toner 23

The materials used for the formation of the toner core materials in Example 2 and 5 parts by weight of a chromium complex type dye (produced by Hodogaya Chemical Co., Ltd. and marketed under trademark designation of "Aizenspiron Black TRH") were thoroughly mixed in a ball mill and then kneaded on a three-piece roll heated at 130° C. The resultant blend was left cooling and then coarsely ground with a feather mill to obtain a coarse toner powder having a maximum particle diameter of 3 mm. A toner having an average particle diameter of 8 μm was obtained by mixing 100 parts by weight of the coarse toner powder thus obtained with 1.0 part by weight of electroconductive minute particles of a tin oxide type compound having an average particle diameter of 0.1 μm and a volume intrinsic resistance of 5 Ω·cm (produced by Mitsubishi Metal Corp. and marketed under product code of "T-1"), placing the resultant mixture in a Henschel mixer, stirring it at a revolution number of 1,500 rpm for two minutes, then finely pulverizing the blend with a jet mill (produced by Kawasaki Jukygyo Kabushiki Kaisha and marketed under trademark designation of "Crypton System"), and thereafter aerially classifying the resultant fine powder. When the surface of a toner particle thus obtained was observed under a scanning electron microscope, the tin oxide type minute particles were found to be fixed locally on the toner surface. A toner 23 having an average particle diameter of 8 μm was obtained by mixing 100 parts by weight of the particles obtained above with 1.0 part by weight of minute particles of resin having an average particle diameter of 50 m μ (produced by Nippon Paint Co., Ltd.), placing the resultant mixture in a Henschel mixer, stirring it at a revolution number of 1,500 rpm for one minute, and aftertreating the blend as practiced for a toner.

Example 12

Production of toner 24

Toner core particles having an average particle diameter of 8 μm were obtained by following the procedure of Example 8. Separately, electroconductive minute particles of a titanium dioxide-tin oxide type complex having an average particle diameter of 0.2 μm and a volume intrinsic resistance of 50 Ω·cm (produced by Mitsubishi Metal Corp. and marketed under product code of "W-10") were thoroughly dispersed in ethanol. In a wet surface-modifying device (produced by Nisshin Engineering Ltd. and marketed under trademark designation of "Dispercoat"), the toner core particles were treated by the solution immersion method using the dispersion obtained above so that 2.0 parts by weight of the electroconductive minute particles would be fixed locally on the surface of 100 parts by weight of the toner core particles. When the surface of a toner particle consequently obtained was observed under a scanning electron microscope, the minute particles of the titanium dioxide-tin oxide type complex were found to be fixed locally on the toner surface. A toner 24 having an average particle diameter of 6 μm was obtained by mixing 100 parts by weight of the particles obtained above with 1.0 part by weight of minute particles of resin having an average particle diameter of 80 m μ (produced by Nippon Paint Co., Ltd. and marketed under product code of "N-300"), placing the resultant mixture in a Henschel mixer, stirring it at a revolution number of 1,500 rpm for one minute, and aftertreating the blend as practiced for a toner.

Control 13

Production of toner 25

A toner 25 having an average particle diameter of 8 μm was obtained by following the procedure of Example 10, except the addition of the electroconductive minute particles to the coarse toner powder was omitted.

Control 14

Production of toner 26

Toter particles having an average particle diameter of 8 μm were obtained by following the procedure of Example 11, except the addition of the electroconductive minute particles to the coarse toner powder was omitted. Then, 100 parts by weight of the particles thus obtained and 1.0 part by weight of electroconductive minute particles of a tin oxide type compound having an average particle diameter of 0.1 μm and a volume intrinsic resistance of 5 Ω·cm (produced by Mitsubishi Metal Corp. and marketed under product code of "T-1") were mixed and the resultant mixture was placed in a Henschel mixer and stirred therein at a revolution number of 1,500 rpm for one minutes. When the surface of a toner particle thus obtained was observed under a scanning electron microscope, the minute particles of the tin oxide type compound were found to be uniformly fixed on the toner surface. A toner 26 having an average particle diameter of 6 μm was obtained by mixing 100 parts by weight of the particles consequently obtained with 1.0 part by weight of minute particles of resin having an average particle diameter of 50 m μ (produced by Nippon Paint Co., Ltd. and marketed under product code of "P-1000"), placing the resultant mixture in a Henschel mixer, stirring it at a revolution number of 1,500 rpm for one minute, and aftertreating the blend as practiced for a toner.

Control 15

Production of toner 27

A toner 27 having an average particle diameter of 8 μm was obtained by following the procedure of Example 12, except the surface treatment of the toner particles performed in a wet surface-modifying device (produced by Nisshin Engineering Ltd. and marketed under trademark designation of "Dispercoat") using the electroconductive minute particles was carried out by the slurry method in the place of the solution immersion method after the toner particles and the electroconductive minute particles were thoroughly stirred in a mixed solution of ethanol and water until a uniform blend was formed. When the surface of a toner particle before the aftertreatment with the minute particles of resin was observed under a scanning electron microscope, the minute particles of the titanium dioxide-tin oxide type complex were found to be uniformly fixed on the toner surface.

Method for evaluation of properties:

The toners 13 to 15 obtained in Examples 10 to 12 and Controls 13 to 15 as described above were tested for various properties as follows.

State of attachment/fixation of minute particles (non-insulating minute particles):

The surface image of a sample toner particle (prior to the aftertreatment) which had non-insulating minute particles (electroconductive minute particles) fixed thereon was injected into an image analyzing device with the aid of a scanning electron microscope. The surface image displayed in the device was examined to determine the state of distribution of the minute particles fixed on the surface of the toner particle.

First, the operation of the steps (1) to (3) was performed in the same manner as used for the toners 1 to 11.

(4) The areas in which the ratio of surface determined in the step (3) above was not more than 50% of the average fixation density were selected and the proportion of these selected areas to the total of all the areas was calculated.

(5) The operation of (4) was performed on 50 particles and the values found in the 50 runs were averaged. The average was reported as the ratio of area of coarse density of the minute particles. The ratios of surface area of coarse density found by the method described above for the toners obtained in Examples 10 to 12 and Controls 13 to 15 are shown in Table 3.

Determination of amount of developing toner fixed on photosensitive material:

A binary developing agent was prepared by mixing a sample toner from Examples 10 to 12 and Controls 13 to 15 and the carrier obtained in Referential Example 4 in a weight ratio, toner/carrier, of 7/93. A developing agent originating in Example 10 and Control 13 was used for production of an image with EP-470 Z (proprietary product of Minolta Camera Co., Ltd.) and a developing agent originating in Examples 11 and 12 and Controls 14 and 15 with EP-570 Z (proprietary product of Minolta Camera Co., Ltd.). A wholly black image was developed. The latent image covered with the toner was removed from the copier en route to the transfer unit. From a prescribed surface area of the toner image, the toner was removed by suction with a vacuum pump fitted with a filter. The removed toner was weighed to determine the developing amount of the toner per unit surface area. The developing amount of the toner was rated on the three-point scale, wherein ○ stands for an amount of not less than 0.5 mg/cm$^2$, Δ for an amount of not less than 0.4 mg/cm$^2$, and X for an amount of less than 0.4 mg/cm$^2$. Though the samples rated for the first two ranks fitted practical use, those rated for the first rank proved to be favorably usable. The results are shown in Table 3.

Determination of transfer efficiency:

In the determination of the fixed amount of a developing toner, the amount of the developing toner which has escaped transfer to a photosensitive paper was found by carrying out the measurement on the photosensitive material which had passed the transfer unit. The efficiency of transfer of the developing toner was calculated by finding the ratio of the fixed amount of the developing toner to the amount of the developing toner which had escaped the transfer.

(Efficiency of transfer) = {(Fixed amount of developing toner) − (Amount of developing toner not transferred)}/(Fixed amount of developing toner) × 100

The efficiency of transfer was rated on the three-point scale, wherein ○ stands for efficiency of not less than 90%, Δ for efficiency of not less than 80%, and X for efficiency of less than 80%. Though the samples winning the first two ranks were acceptable for practical use, those winning the first rank were favorably used. The results are shown in Table 3.

TABLE 3

| | Toner | Ratio of area of coarse density of minute particles (%) | Fixed amount on photosensitive material | Efficiency of transfer | Amount of initial charge (μC/g) |
|---|---|---|---|---|---|
| Example 10 | 22 | 40 | ○ | ○ | +16.5 |
| Example 11 | 23 | 50 | ○ | ○ | −17.0 |
| Example 12 | 24 | 40 | ○ | ○ | −20.7 |
| Control 13 | 25 | — | X | ○ | +15.0 |
| Control 14 | 26 | 10 | Δ | X | −19.3 |
| Control 15 | 27 | 5 | Δ | X | −16.3 |

Example 13

Production of toner 28

A toner 28 having an average particle diameter of 8 μm was obtained by following the procedure of Example 10, except 2.0 parts by weight of magnetic minute particles having an average particle diameter of 0.3 μm (produced by Titan Kogyosha and marketed under product code of "BL-500") was used in the place of the electroconductive carbon black.

Example 14

Production of toner 29

A toner 29 having an average particle diameter of 8 μm was obtained by following the procedure of Example 11, except 2.0 parts by weight of magnetic minute particles having an average particle diameter of 0.6 μm (produced by TDK K.K. and marketed under product code of "MFP-2") was used in the place of the electroconductive minute particles of the tin oxide type compound (T-1).

Example 15

Production of toner 30

A toner 30 having an average particle diameter of 6 μm was obtained by following the procedure of Example 12, except 2.0 parts by weight of magnetic minute particles having an average particle diameter of 0.6 μm (produced by TDK K.K. and marketed under product code of "MFP-2") was used in the place of the electroconductive minute particles of the titanium dioxide-tin oxide type complex (W-10).

Control 16

Production of toner 31

A toner 31 having an average particle diameter of 8 μm was obtained by following the procedure of Example 13, except the addition of the magnetic minute particles to the coarse toner powder was omitted.

Control 17

Production of toner 32

Toner particles having an average particle diameter of 8 μm were obtained by following the procedure of Example 14, except the addition of the magnetic minute particles to the coarse toner powder was omitted. Then, a toner 32 having an average particle diameter of 6 μm was obtained by mixing 100 parts by weight of the particles consequently prepared with 2.0 parts by weight of magnetic minute particles having an average particle diameter of 0.8 μm (produced by TDK K.K. and marketed under product code of "MFP-2"), placing the resultant mixture in a Henschel mixer, stirring it at a revolution number of 1,500 rpm for one minute, then mixing 100 parts by weight of the resultant blend with 1.0 part by weight of minute particles of resin having an average particle diameter of 50 mμ (produced by Nippon Paint Co., Ltd. and marketed under product code of "P-1000"), placing the resultant mixture in a Henschel mixer, stirring it at a revolution number of 1,500 rpm for one minute, and aftertreating the resultant blend as practiced for a toner.

Control 18

Production of toner 33

A toner 33 having an average particle diameter of 8 μm was obtained by following the procedure of Example 15, except the surface treatment of the toner particles performed with the magnetic minute particles in a wet surface-modifying device (produced by Nisshin Engineering Ltd. and marketed under trademark designation of "Dispercoat") was effected by the slurry method in the place of the solution immersion method after the toner particles and the magnetic minute particles were thoroughly stirred in the ethanol-water mixed solution until a uniform mixture was formed.

Method for evaluation of properties:

The toners obtained in Examples 13 to 15 and Controls 16 to 18 as described above were tested for various properties as follows.

State of attachment/fixation of minute particles (magnetic minute particles):

The operation of the steps (1) to (4) described hereinabove with respect to the toners 1 to 11 was performed.

(5) The areas in which the ratio of surface determined in the step (3) was not more than 50% of the average attachment density were piked out and the proportion of these areas to the total of all the areas was calculated.

(6) The operation of the steps (4) and (5) was carried out on 50 particles and the values found in the 50 runs were averaged. The values thus obtained were reported respectively as the ratio of area of local presence of minute particles and the ratio of area of coarse density of minute particles.

The ratios of surface area of local presence of minute particles determined by these methods with respect to the toners 28 to 33 obtained in Examples 13 to 15 and Controls 13 to 15 are shown in Table 4.

Determination of amount of charge (Q/M) and amount of drift:

A binary developing agent was prepared by mixing a sample toner from Examples 13 to 15 and Controls 16 to 18 with the carrier obtained in Referential Examples 4 in a ratio, toner/carrier, of 5/95. The developing agent originating in Examples 14 and 15 and Controls 17 and 18 was set in EP-570 Z (proprietary product of Minolta Camera Co., Ltd.) or the developing agent originating in Example 13 and Control 16 in EP-470 Z (proprietary product of Minolta Camera Co. Ltd.) and tested for amount of initial charge and for amount of toner drift as a criterion of printability. The test for printability was performed by printing a given image on a chart of B/W ratio of 6% with a sample toner on 100,000 copy papers. The drifted amount of a sample developing agent was measured with a digital dust meter (produced by Shibata Kagakusha K.K.) by installing a magnet roll at a distance of 10 cm from the dust meter, setting 2 g of the sample developing agent on the magnet roll, and rotating the magnet at a rate of 2,500 rpm thereby allowing the dust meter to read as dust the amount of toner particles drifted in consequence of the rotation. The drifted amount indicated by the count displayed on the dust meter after one minutes' measurement was rated on the three-point scale, wherein ○ stands for a count of not more than 100 cpm, Δ for a count of not more than 300 rpm, and X for a count of more than 300 rpm. Though the samples winning the first two ranks were acceptable for practical use, those winning the first rank were favorably usable. The samples winning the third rank possessed a dubious quality for use. The results are shown in Table 4.

Determination of transfer efficiency:

A binary developing agent was prepared by mixing a sample toner from Examples 13 to 15 and Controls 16 to 18 and the carrier obtained in Referential Example 4 in a weight ratio, toner/carrier, of 7/93. This developing agent was used in producing an image with the same copier as used in the test for printability described above. The fixed amount of the developing toner was determined by developing a wholly black image on a copy paper, removing the copy paper carrying the toner on the latent image from the copier en route to the transfer unit, removing the toner from a prescribed surface area of this copy paper with a vacuum pump provided with a filter, and weighing the removed toner. The amount of the toner which had escaped transfer to the copy paper was found by performing the same measurement used for determining the fixed amount of the developing toner on the photosensitive material which had passed the transfer unit. The efficiency of transfer was calculated by finding the ratio of the fixed amount of the developing toner to the amount of the developing toner which had escaped transfer to the copy paper.

(Efficiency of transfer)={(Fixed amount of developing toner)−(Amount of developing toner not transferred)}/(Fixed amount of developing toner)×100

The efficiency of transfer was rated on the three-point scale, wherein ○ stands for efficiency of not less than 90%, Δ for efficiency of not less than 80%, and X for efficiency of less than 80%. Though the samples winning the first two ranks were acceptable for practical use, the samples winning the first rank were favorably used. The results are shown in Table 4.

TABLE 4

| | Toner | Ratio of area for local presence of minute particles (%) | Ratio of area of coarse density of minute particles (%) | Amount of initial charge (μC/g) | Amount of drift: Initial | After 10000 papers printing | After 100000 papers printing | Efficiency of transfer |
|---|---|---|---|---|---|---|---|---|
| Example 13 | 28 | 47 | 37 | +16.7 | ○ | ○ | ○ | ○ |
| Example 14 | 29 | 42 | 41 | −17.0 | ○ | ○ | ○ | ○ |
| Example 15 | 30 | 41 | 43 | −20.5 | ○ | ○ | ○ | ○ |
| Control 16 | 31 | — | — | +18.0 | X | X | X | ○ |
| Control 17 | 32 | 6 | 10 | −15.1 | Δ | X | X | X |

TABLE 4-continued

| | Toner | Ratio of area for local presence of minute particles (%) | Ratio of area of coarse density of minute particles (%) | Amount of initial charge (μC/g) | Amount of drift: Initial | After 10000 papers printing | After 100000 papers printing | Efficiency of transfer |
|---|---|---|---|---|---|---|---|---|
| Control 18 | 33 | 3 | 8 | −23.0 | Δ | Δ | X | X |

Example 16

Production of toner 34

Toner core particles having an average particle diameter of 8 μm were obtained by following the procedure of Example 8. Separately, minute particles of ethylene-propylene fluoride resin having an average particle diameter of 0.2 μm (proprietary product of Mitsui-DuPont Fluorochemical Ltd.) were thoroughly dispersed in an ethanol/water (volume ratio 8:2) mixed solution. Then, in a wet surface-modifying device (produced by Nisshin Engineering Ltd. and marketed under trademark designation of "Dispercoat"), the toner core particles were treated by the solution immersion method using the dispersion obtained above so that 2.0 parts by weight of the minute particles of resin would be fixed locally on the surface of 100 parts by weight of the toner core particles. Further, a toner 34 having an average particle diameter of 8 μm was obtained by mixing 100 parts by weight of the particles obtained consequently and 0.3 part by weight of hydrophobic silica having an average particle diameter of 17 m μ (produced by Japan Aerosil Ltd. and marketed under product code of "R-974"), placing the resultant mixture in a Henschel mixer, stirring it at a revolution number of 1,500 rpm for one minute, and aftertreating the blend as practised for a toner.

Example 17

Production of toner 35

A homogeneous mixed dispersion was obtained by dissolving 100 g of a polyester resin (produced by Kao Soap Co., Ltd. and marketed under product code of "NE-1110") in 400 g of a mixed methylene chloride/toluene (volume ratio 8/2) solvent and thoroughly mixing to disperse 8 g of carbon black (produced by Mitsubishi Chemical Industries, Ltd. and marketed under product code of "MA #8") and 5 g of a chromium complex type dye (produced by Hodogaya Chemical Co., Ltd. and marketed under trademark designation of "Aizenspiron Black TRH") with the solution obtained above in a ball mill for three hours. Then, the homogeneous mixed dispersion mentioned above was suspended in an aqueous solution prepared by dissolving 60 g of a 4 w/v % solution of methyl cellulose (produced by the Dow Chemical Company and marketed under trademark designation of "Metcell K 35 LV") as a dispersion stabilizer, 5 g of a 1 w/v solution of sodium dioctyl sulfosuccinate (produced by Nikko Chemical Co., Ltd. and marketed under trademark designation of "Nikkol OTP 75"), and 0.5 g of sodium hexamethaphosphate (proprietary product of Wako Pure Chemical Industries Ltd.) in 1,000 g of deionized water. In this case, a mixer (produced by Tokushu Kika Kogyo K.K. and marketed under trademark designation of "TK Autohomomixer") was used with the revolution number adjusted so that the aforementioned homogeneous dispersion would form liquid drops having an average diameter in the range of from 3 to 10 μm. After completion of suspension and pelletization, the produced particles were washed with deionized water, dried, and aerially classified to obtain a toner having an average particle diameter of 8 μm. Separately, spherical silica minute particles having an average particle diameter of 0.3 μm (produced by Nippon Shokubai Kagaku Kogyo Co., Ltd. and marketed under trademark designation of "Seahoster KEP-30") were thoroughly dispersed in a mixed ethanol/water (volume ratio 8:2) solution. Then, in a wet surface-modifying device (produced by Nisshin Engineering Ltd. and marketed under trademark designation of "Dispercoat"), the toner particles were treated by the solution immersion method using the dispersion produced above so that 1.0 part by weight of the spherical silica minute particles would be fixed locally on the surface of 100 parts by weight of the toner particles. Further, a toner 35 having an average particle diameter of 8 μm was obtained by mixing 100 parts by weight of the particles obtained consequently and 0.5 part by weight of minute particles of resin having an average particle diameter of 80 m μ (produced by Nippon Paint Co., Ltd. and marketed under product code of "N-300"), placing the resultant mixture in a Henschel mixer, stirring it at a revolution number of 1,500 rpm for one minute, and aftertreating the blend as practised for a toner.

Example 18

Production of toner 36

A homogeneous mixed dispersion was obtained by dissolving 100 g of a polyester resin (produced by Kao Soap Co., Ltd. and marketed under product code of "NE-382") in 400 g of a mixed methylene chloride/toluene (volume ratio 8/2) solution and thoroughly dispersing 5 g of phthalocyanine pigment and 5 g of a zinc metal complex (produced by Orient Chemical Industry Ltd. and marketed under product code of "E-84") with the homogeneous mixed dispersion in a ball mill for three hours. Then, this homogeneous mixed dispersion was suspended in an aqueous solution prepared in advance by dissolving 60 g of a 4 w/v % solution of methyl cellulose (produced by the Dow Chemical Company and marketed under trademark designation of "Metcel K 35 LV") as a dispersion stabilizer, 5 g of a 1 w/v % solution of sodium dioctyl sulfosuccinate (produced by Nikko Chemical Co. Ltd. and marketed under trademark designation of "Nikkol OTP 75"), and 0.5 g of sodium hexamethaphosphate (proprietary product of Wako Pure Chemicals Co., Ltd.) in 1,000 g of deionized water. In this case, a mixer (produced by Tokushu Kiki Kogyosha K.K. and marketed under trademark designation of "TK Autohomomixer") was used with the revolution number adjusted so that the aforementioned homogeneous dispersion would form liquid drops having an average diameter in the range of from 3 to 10 μm. After completion of pelletization, the resultant liquid was kept at 50° C. to expel the mixed methylene chloride/toluene (volume ratio 8:2) solution, then washed with deionized water, and subsequently dried and aerially classified, to obtain a toner having an average particle diameter of 6 μm. Separately, minute particles of resin having an average particle diameter of 0.4 μm (produced by Nippon Paint Co., Ltd. and marketed under product code of "P-2000") were thoroughly dispersed in a mixed ethanol/water (volume ratio 1:9) solution. In a wet surface-modifying device (produced by Nisshin Engineering Ltd. and marketed under trademark designation of "Dispercoat"), the toner was treated by the solution immersion method using the mixed solution so that 1.0 part by weight of the minute particles of resin would be fixed locally on the surface of 100 parts by weight of the toner. Then, a toner 36 having an average particle diameter of 6 μm was obtained by mixing 100 parts by weight of the particles obtained above and 0.2 part by weight of hydrophobic silica having an average particle of 17 m μ (produced by Japan Aerosil Ltd. and marketed under product code of "R-974"), placing the resultant mixture in a Henschel mixer, stirring it at a revolution number of 1,500 rpm for one minute, and aftertreating the blend as practised for a toner.

Control 19

Production of toner 37

A toner 37 having an average particle diameter of 8 μm was obtained by following the procedure of Example 16, except the addition of the minute particles of resin to the toner surface by the use of a wet surface-modifying device (produced by Nisshin Engineering Ltd. and marketed under trademark designation of "Dispercoat") was omitted.

Control 20

Production of toner 38

A toner having an average particle diameter of 8 μm was obtained by following the procedure of Example 17, except the addition of the spherical minute particles of silica to the toner surface by the use of the wet surface-modifying device (produced by Nisshin Engineering Ltd. and marketed under trademark designation of "Dispercoat") was omitted. Then, a toner 38 having an average particle diameter of 8 μm was obtained by mixing 100 parts by weight of the particles obtained consequently and 1.0 part by weight of spherical minute particles of silica having an average particle diameter of 0.3 μm (produced by Nihon Shokubai Kagaku Kogyo Co., Ltd. and marketed under trademark designation of "Seahoster KEP-30"), placing the resultant mixture in a Henschel mixer, stirring it at a revolution number of 1,500 rpm for one minute, subsequently mixing 100 parts by weight of the particles produced above and 0.5 part by weight of minute particles of resin having an average particle diameter of 80 m μ (produced by Nippon Paint Co., Ltd. and marketed under product code of "N-300"), placing the resultant mixture in a Henschel mixer, stirring it at a revolution number of 1,500 rpm for one minute, and aftertreating the blend as practised for a toner.

Control 21

Production of toner 39

A toner 39 having an average particle diameter of 6 μm was obtained by following the procedure of Example 18, except the surface treatment of the toner particles with the minute particles of resin by the use of a wet surface-modifying device (produced by Nisshin Engineering Ltd. and marketed under trademark designation of "Dispercoat") was performed not by the solution immersion method but by the slurry method after the toner particles and the minute particles of resin were thoroughly stirred in the mixed ethanol/water solution until a homogeneous mixture was obtained.

Control 22

Production of toner 40

A toner 40 having an average particle diameter of 6 μm was obtained by following the procedure of Control 21, except the amount of the minute particles of resin to be added was changed to 20 parts by weight, based on 100 parts by weight of the toner.

Method for evaluation of properties:

The toners 34 to 40 obtained in Examples 16 to 18 and Controls 19 and 22 as described above were tested for properties as follows.

State of attachment/fixation of minute particles (cleanability-improving grade minute particles):

The toners 35 to 40 obtained in Examples 16 to 18 and Controls 19 to 22 were tested for ratio of surface area of coarse density of minute particles in the same manner as used on the toners 22 to 27. The results are shown in Table 5.

Determination of amount of charge (Q/M):

A sample toner from Examples 16 to 18 and Controls 19 to 22 was tested for amount of initial charge by placing 2 g of the sample toner and 28 g of the carrier obtained in Referential Example 4 in a polyethylene vial having an inner volume of 50 cc, mounting the vial on a rotary stand, rotating the vial at a revolution number of 1,200 rpm for one hour thereby stirring the contents of the vial, and measuring the amount of charge in the resultant mixture. The results are shown in Table 5.

Evaluation of cleanability:

A binary developing agent was prepared by mixing a sample toner from Examples 16 to 18 and Controls 19 to 22 with the carrier at a ratio, toner/carrier, of 5/95. The developing agent was subjected to a test for printability by the use of EP-570 Z (proprietary product of Minolta Camera Co., Ltd.) to determine the cleanability thereof. The test for printability was performed by printing a sample image of a chart having a B/W ratio of 15% on 100,000 copy papers. The images produced on the copy papers and the photosensitive material were visually examined to determine presence/absence of loose toner particles as a criterion of cleanability of the toner. The cleanability was evaluated on the two-point scale, wherein X stands for rejectability evinced by the occurrence of a strip of noise on the image due to the slip of toner particles under the cleaning blade, or discernible presence of residual toner particles on the surface of the photosensitive material and ○ for acceptability ascribable to the absence of residual toner particles. The results are shown in Table 5.

Evaluation of fixability:

The toners 34 to 40 obtained in Examples 16 to 18 and Controls 19 to 22 were tested for high-speed fixability as follows. A fixing device having a fixing roller 40 mm in diameter coated with polytetrafluoroethylene and pressed against a roller of low temperature vulcanization (LTV) silicone rubber with a pressure of 80 kg was operated at a rotary speed of 45 cm/sec to find the strength of fixation required for I.D. of 1.2 when the toner was fixed at 175° C. The symbol "I.D." represents the value of image density determined with a Sakura reflectance meter. The strength of fixation was determined by rubbing a copied image with a special device produced by mounting a load of 1 kg on a sand-rubber eraser until erasure and reported in the percentage of the ratio of the reflection densities before and after the rubbing. The strength of fixation for I.D. of 1.2 is desired to be not less than 80%. The results are shown in Table 5.

TABLE 5

| | Toner | Ratio of area of coarse density of minute particles (%) | Amount of initial charge (μC/g) | Cleanability Initial | After 1000 papers printing | After 10000 papers printing | Strength of fixation (%) |
|---|---|---|---|---|---|---|---|
| Example 16 | 34 | 43 | −16.3 | ○ | ○ | ○ | 97 |
| Example 17 | 35 | 57 | −18.0 | ○ | ○ | ○ | 96 |
| Example 18 | 36 | 62 | −20.4 | ○ | ○ | ○ | 95 |
| Control 19 | 37 | — | −14.6 | X | X | X | 96 |
| Control 20 | 38 | — | −19.2 | ○ | X | X | 95 |
| Control 21 | 39 | 7 | −20.1 | ○ | X | X | 93 |
| Control 22 | 40 | 0 | −21.1 | ○ | ○ | X | 72 |

Example 19

Production of toner 41

Core particles g having an average particle diameter of 8 μm was obtained by following the procedure of Example 1, except 5 parts by weight of a chromium complex type charge-controlling agent (produced by Hodogaya Chemical Co., Ltd. and marketed under trademark designation of "Aizenspiron Black TRH") was added as a material for the formation of toner core particles. Separately, hydrophobic rutile type titanium oxide having an average particle diameter of 30 m μ and a dielectric constant of 114 was thoroughly dispersed in ethanol. Then, in a wet surface-modifying device (produced by Nisshin Engineering Ltd. and marketed under trademark designation of "Dispercoat"), the core particles g were treated by the solution immersion method using the dispersion obtained above so that 1.5 parts by weight of the rutile type titanium dioxide would be fixed locally on the surface of the core particles.

When the surface of a toner particle 41 thus obtained was observed under a scanning electron microscope, the titanium dioxide minute particles were found to be fixed locally on the surface of the toner.

Further, 100 parts by weight of the toner 41 obtained as described above was mixed with 0.3 part by weight of hydrophobic silica having an average particle diameter of 12 m μ (produced by Japan Aerosil Ltd. and marketed under product code of "R-974") and the resultant mixture was placed in a Henschel mixer and stirred therein at a revolution number of 1,500 rpm for one minute and aftertreated as practised for a toner.

Control 23

Production of toner 42

A toner 42 having an average particle diameter of 8 μm was obtained by thoroughly dispersing 100 parts by weight of the core particles g obtained in Example 19 in a mixed water/ethanol (weight ratio 50/50) solution, then mixing the resultant dispersion with 1.5 parts by weight of hydrophobic rutile type titanium dioxide having an average particle diameter of 30 m μ and a dielectric constant of 114, treating the resultant mixture in a wet surface-modifying device (produced by Nisshin Engineering Ltd. and marketed under trademark designation of "Dispercoat") so that the titanium dioxide would be uniformly fixed on the surface of the core particles g.

When the surface of a toner particle 42 thus obtained was observed under a scanning electron microscope, the titanium dioxide minute particles were found to be fixed as uniformly dispersed on the toner surface.

Further, the toner 42 obtained consequently was aftertreated with the same hydrophobic silica having an average particle diameter of 12 m μ (produced by Japan Aerosil Ltd. and marketed under product code of "R-974") as used in Example 1.

Control 24

Production of toner 43

A toner 43 having an average particle diameter of 8 μm was obtained by following the procedure of Example 19, except 0.7 part by weight of hydrophobic silica having an average particle diameter of 12 m μ (produced by Japan Aerosil Ltd. and marketed under product code of "R-974") and 0.8 part by weight of hydrophobic anatase type titanium dioxide having an average particle diameter of 30 m μ and a dielectric constant of 31 were used in the place of the hydrophobic rutile type titanium dioxide.

When the surface of a toner particle 43 was observed under a scanning microscope, the minute particles of titanium dioxide and silica were found to be fixed locally on the toner surface. Further, the toner 43 obtained consequently was aftertreated with the same hydrophobic silica having an average particle diameter of 12 m μ (produced by Japan Aerosil Ltd. and marketed under product code of "R-974") as used in Example 19.

Control 25

Production of toner 44

A toner 44 having an average particle diameter of 8 μm was obtained by following the procedure of Control 23, except the amount of the hydrophobic rutile type titanium dioxide to be added was changed to 5 parts by weight.

When the surface of a toner particle 44 obtained above was observed under a scanning microscope, the minute particles of the titanium dioixde were found to be fixed as uniformly dispersed on the toner surface.

The toner 44 thus obtained was aftertreated with the same hydrophobic silica having an average particle diameter of 12 mμ (produced by Japan Aerosil Ltd. and marketed under product code of "R-974").

Example 20

Production of toner 45

A toner 45 having an average particle diameter of 8 μm was obtained by fixing hydrophobic rutile type titanium dioxide having an average particle diameter of 30 mμ and a dielectric constant of 114 in the same manner as in Example 19 on the core particles d obtained in Example 7.

When the service of a toner particle E obtained consequently was observed under a scanning microscope, the minute particles of titanium dioxide were found to be fixed locally on the toner surface.

Further, the toner 45 obtained above was aftertreated with hydrophobic silica having an average particle diameter of 12 mμ (produced by Japan Aerosil Ltd. and marketed under product code of "R-974") in the same manner as in Example 19.

Method for evaluation of properties:

The toners obtained in Examples 19 and 20 and Controls 23 to 25 as described above were tested for various properties as follows.

State of attachment/fixation of minute particles (highly dielectric minute particles):

The toners 41 to 45 obtained in Examples 19 and 20 and Controls 23 to 25 were tested for ratio of surface area of local presence of minute particles in the same manner as performed on the toners 1 to 11. The results are shown in Table 6.

Determination of developing toner:

A binary developing agent was prepared by mixing a sample toner from Examples 19 and 20 and Controls 23 to 25 and the carrier obtained in Referential Example 4 in a weight ratio, toner/carrier, 7/93. In a copier (produced by Minolta Camera Co., Ltd. and marketed under product code of "EP-570 Z") so adjusted that the difference between the surface potential of the photosensitive material and that of the developing agent carrier would fall at 500 (V) in the solid part, the developing agent mentioned above was used to develop a sample image. The toner adhering to the unit surface area on the photosensitive material prior to transfer was removed by suction with a pump and the removed developing toner was weighed. The results are shown in Table 6.

Determination of image density:

The development was carried out in the same manner as in the determination of the amount of the developing agent. The developed image was transferred onto an EP paper (proprietary product of Minolta Camera Co., Ltd.), fixed thereon, and tested for density by the use of a Sakura reflectance meter. The results are shown in Table 6.

Determination of strength of fixation:

The development was carried out in the same manner as in the determination of the amount of the developing agent. The developed image was transferred onto an EP paper (proprietary product of Minolta Camera Co., Ltd.) and the toner image was fixed by the use of a fixing device. The fixing device comprised a fixing roller 40 mm in diameter coated with polytetrafluoroethylene and a roller of low temperature vulcanization silicone rubber pressed upwardly against the fixing roller with a pressure of 80 kg. These rollers were operated at a fixed peripheral speed of 30 cm/sec and heated to 175° C.

The strength of fixation was determined by rubbing the fixed toner image on the solid part with a sand-rubber eraser kept under a load of 1 kg and reported by the percentage of the ratio of image densities before and after the rubbing. The image density was measured by the use of a Sakura reflectance meter.

The strength of fixation is desired to be not less than 80%. The results are shown in Table 6.

Evaluation of printability:

A sample image of a chart of W/B ratio of 6% was printed on 50,000 copy papers in the same manner as in the determination of image density. The surface of the photosensitive material used for the printing were observed under a microscope to find presence/absence of injury thereof as a criterion of printability. The results are shown in Table 6.

Evaluation of disfigurement in line edge:

From a sample subject copy containing an image of lines 0.2 in width, development was carried out in the same manner as in the determination of the amount of developing toner. The toner on the photosensitive material used for the development was observed under a microscope. The disfigurement of the line edge was evaluated by the amount of loose toner particles falling on and near the edge part of the toner image. The results are shown in Table 6.

TABLE 6

| | Toner | Ratio of area for local presence of minute particles (%) | Amount of developing toner (mg/cm$^2$) | Image density | Strength of fixation (%) | Evaluation of printability | Disfigurement in line edge |
|---|---|---|---|---|---|---|---|
| Example 19 | 41 | 44 | 0.75 | 1.49 | 92 | No injury found on the photosensitive material | Very few scattered toner particles near line part and sharp edge formed |
| Control 23 | 42 | 6 | 0.58 | 1.38 | 90 | No injury found on the photosensitive material | Small amount of toner adhering to line part and no sharp edge formed |
| Control 24 | 43 | 45 | 0.51 | 1.34 | 89 | No injury found on the photosensitive material | Fairly small amount of toner adhering to line part and no very sharp edge formed |
| Control 25 | 44 | 9 | 0.77 | 1.49 | 66 | Fine injury discernible on the photosensitive | Toner adhering in fairly large width to line image and |

TABLE 6-continued

| | Toner | Ratio of area for local presence of minute particles (%) | Amount of developing toner (mg/cm$^2$) | Image density | Strength of fixation (%) | Evaluation of printability | Disfigurement in line edge |
|---|---|---|---|---|---|---|---|
| | | | | | | material | large amount of toner scattered near edge |
| Example 20 | 45 | 39 | 0.11 | Not determined (color toner) | 93 | No injury found on the photosensitive material | Very few scattered toner particles near line part and sharp edge formed |

We claim:

1. An electrostatic latent image-developing toner particle comprising a binder resin, a coloring agent and charge-controlling minute particles which are fixed on the surface of the toner particle such that an area having a predetermined fixation density of the charge-controlling minute particles is not less than 20% of the entire surface thereof, said fixation density is 1.5 or more times as much as an average fixation density which is the ratio of the charge-controlling minute particles to the entire surface of the toner particles.

2. A developing toner according to claim 1, wherein said charge-controlling minute particles are at least one member selected from the group consisting of a charge-controlling agent, charge-controlling resin minute particles, and inorganic minute particles possessing a charge-controlling property.

3. A developing toner according to claim 1, wherein the volume average particle diameter ($d_{CCA}$) of said charge-controlling minute particles has the relation, $d_{CCA} \leqq d_{TONER}/20$, with respect to the area average particle diameter ($d_{TONER}$) of said toner particles.

4. A developing toner according to claim 1, wherein the volume average particle diameter ($d_{CCA}$) of said charge-controlling minute particles has the relation, $d_{TONER}/100 \leqq d_{CCA} \leqq d_{TONER}/20$, with respect to the area average particle diameter ($d_{TONER}$) of said toner particles.

5. A developing toner according to claim 1, wherein the amount of said charge-controlling minute particles to be added is in the range of from 0.001 to 10 parts by weight, based on 100 parts by weight of said toner particles.

6. A developing toner according to claim 1, wherein the volume average particle diameter of said charge-controlling minute particles is not more than 1 μm.

7. An electrostatic latent image-developing toner particle comprising a binder resin, a coloring agent and minute particles of a fluidifying agent which are attached or fixed on the surface of the toner particles such that an area having a predetermined fixation density of the minute particles of a fluidifying agent is not less than 20% of the entire surface thereof, said fixation density is 1.5 or more times as much as an average fixation density which is the ratio of the minute particles of a fluidifying agent to the entire surface of the toner particles.

8. A developing toner according to claim 7, wherein the amount of the minute particles of said fluidifying agent to be added is in the range of from 0.1 to 10 parts by weight, based on 100 parts by weight of said toner particles.

9. A developing toner according to claim 7, wherein the average particle diameter of the minute particles of said fluidifying agent is not more than 1 μm.

10. An electrostatic latent image-developing toner particle comprising binder resin, a coloring agent and non-insulating minute particles having a volume intrinsic electric resistance of not more than $10^{10}$ Ω.cm which are attached or fixed on the surface of the toner particles, such that an area having a predetermined fixation density of the non-insulating minute particles is not less than 20% of the entire surface thereof, said fixation density is ½ or less times as much as an average fixation density which is the ratio of the non-insulating minute particles to the entire surface of the toner particles.

11. A developing toner according to claim 10, wherein the amount of said non-insulating minute particles to be added is in the range of from 0.1 to 10 parts by weight, based on 100 parts by weight of said toner particles.

12. A developing toner according to claim 10, wherein the average particle diameter of said non-insulating minute particles is not more than 1 μm.

13. A developing toner according to claim 10, wherein a fluidifying agent is additionally attached uniformly to the surface of said toner particles.

14. An electrostatic latent image-developing toner particle comprising a binder resin, a coloring agent and magnetic minute particles which are attached or fixed on the surface of the toner particles, such that an area having a predetermined fixation density of the magnetic minute particles is not less than 20% of the entire surface thereof, said fixation density is 1.5 or more times as much as an average fixation density which is the ratio of the magnetic minute particles to the entire surface of the toner particles.

15. A developing toner according to claim 14, wherein the amount of said magnetic minute particles to be added is in the range of from 0.1 to 10 parts by weight, based on 100 parts by weight of said toner particles.

16. A developing toner according to claim 14, wherein the average particle diameter of said magnetic minute particles is not more than 2 μm.

17. A developing toner according to claim 14, wherein a fluidifying agent is additionally attached uniformly to the surface of said toner particles.

18. An electrostatic latent image-developing spherical toner particle comprising a binder resin, a coloring agent and inorganic or organic minute particles possessing an average particle diameter in the range of 1/100 to 1/10 of the average particle diameter of the spherical toner particles, which is attached or fixed on the surface of the spherical toner particles, such that an area having a predetermined fixation density of the inorganic or organic minute particles is not less than 20% of the entire surface thereof, said fixation density, is ½ or less times as much as an average fixation density which is the ratio of the inorganic or organic minute particles to the entire surface of the toner particle.

19. A developing toner according to claim 18, wherein the amount of said minute particles to be added is in the range of from 0.5 to 10 parts by weight, based on 100 parts by weight of said toner particles.

20. A developing toner according to claim 18, wherein a fluidifying agent having an average particle diameter in the range of from 0.001 to 0.1 μm is additionally fixed uniformly on the surface of said toner particles in an amount in the range of from 0.01 to 3.0 parts by weight, based on 100 parts by weight of said toner particles.

21. An electrostatic latent image-developing toner particle comprising a binder resin, a coloring agent and highly dielectric minute particles possessing a dielectric constant of not less than 100 which are fixed on the surface of the toner particles, such that an area having a predetermined fixation density of the highly dielectric minute particles is not less than 20% of the entire surface thereof, said fixation density is 1.5 or more times as much as an average fixation density which is the ratio of the highly dielectric minute particles to the entire surface of the toner particles.

22. A developing toner according to claim 21, wherein the amount of said highly dielectric minute particles to be added is in the range of from 0.1 to 3 parts by weight, based on 100 parts by weight of said toner particles.

23. A developing toner according to claim 21, wherein said highly dielectric minute particles possess an average particle diameter in the range of from 0.001 to 1 μm.

* * * * *